US009506235B2

(12) United States Patent
Adams et al.

(10) Patent No.: US 9,506,235 B2
(45) Date of Patent: Nov. 29, 2016

(54) DRAINAGE TRENCH UNIT AND TRANSPORT UNIT FORMED FROM SUCH DRAINAGE TRENCH UNITS

(71) Applicant: FRÄNKISCHE ROHRWERKE Gebr. Kirchner GmbH & Co. KG, Königsberg (DE)

(72) Inventors: Dietmar Adams, Dresden OT Pappritz (DE); Michael Schütz, Zeil am Main (DE)

(73) Assignee: FRÄNKISCHE ROHRWERKE Gebr. Kirchner GmbH & Co. KG, Königsberg (DE)

( * ) Notice: Subject to any disclaimer, the term of this patent is extended or adjusted under 35 U.S.C. 154(b) by 36 days.

(21) Appl. No.: 14/356,957

(22) PCT Filed: Nov. 9, 2012

(86) PCT No.: PCT/EP2012/072284

§ 371 (c)(1),
(2) Date: May 8, 2014

(87) PCT Pub. No.: WO2013/068541

PCT Pub. Date: May 16, 2013

(65) Prior Publication Data

US 2014/0291221 A1 Oct. 2, 2014

(30) Foreign Application Priority Data

Nov. 9, 2011 (DE) ..... 10 2011 086 016

(51) Int. Cl.
*E03F 1/00* (2006.01)
*E03F 3/04* (2006.01)

(52) U.S. Cl.
CPC ..... *E03F 3/046* (2013.01); *E03F 1/005* (2013.01)

(58) Field of Classification Search
CPC combination set(s) only.
See application file for complete search history.

(56) References Cited

U.S. PATENT DOCUMENTS

2007/0181197 A1 8/2007 Krichten et al.
2008/0166182 A1* 7/2008 Smith ..... E03F 1/005 405/36

(Continued)

FOREIGN PATENT DOCUMENTS

EP 1416099 5/2004
EP 1743984 A1 * 6/2006

(Continued)

OTHER PUBLICATIONS

European Search Report of EP 12 19 2007 dated Jan. 16, 2013.

(Continued)

*Primary Examiner* — Benjamin Fiorello
*Assistant Examiner* — Kyle Armstrong
(74) *Attorney, Agent, or Firm* — Rankin, Hill & Clark LLP

(57) ABSTRACT

The invention relates to a drainage trench unit (10) which comprises at least one drainage trench sub-unit (12), the at least one drainage trench sub-unit (12) having a base wall (16) and a plurality of hollow pillars (18), said pillars (18) being connected integrally to the base wall (16) and tapering, preferably conically, away from the base wall (16), i.e. tapering from their base end (18*a*) to their top end (18*b*). The invention also relates to a transport unit for transporting a plurality of such drainage trench units (10).

19 Claims, 12 Drawing Sheets

(56) References Cited

U.S. PATENT DOCUMENTS

Figure 1:
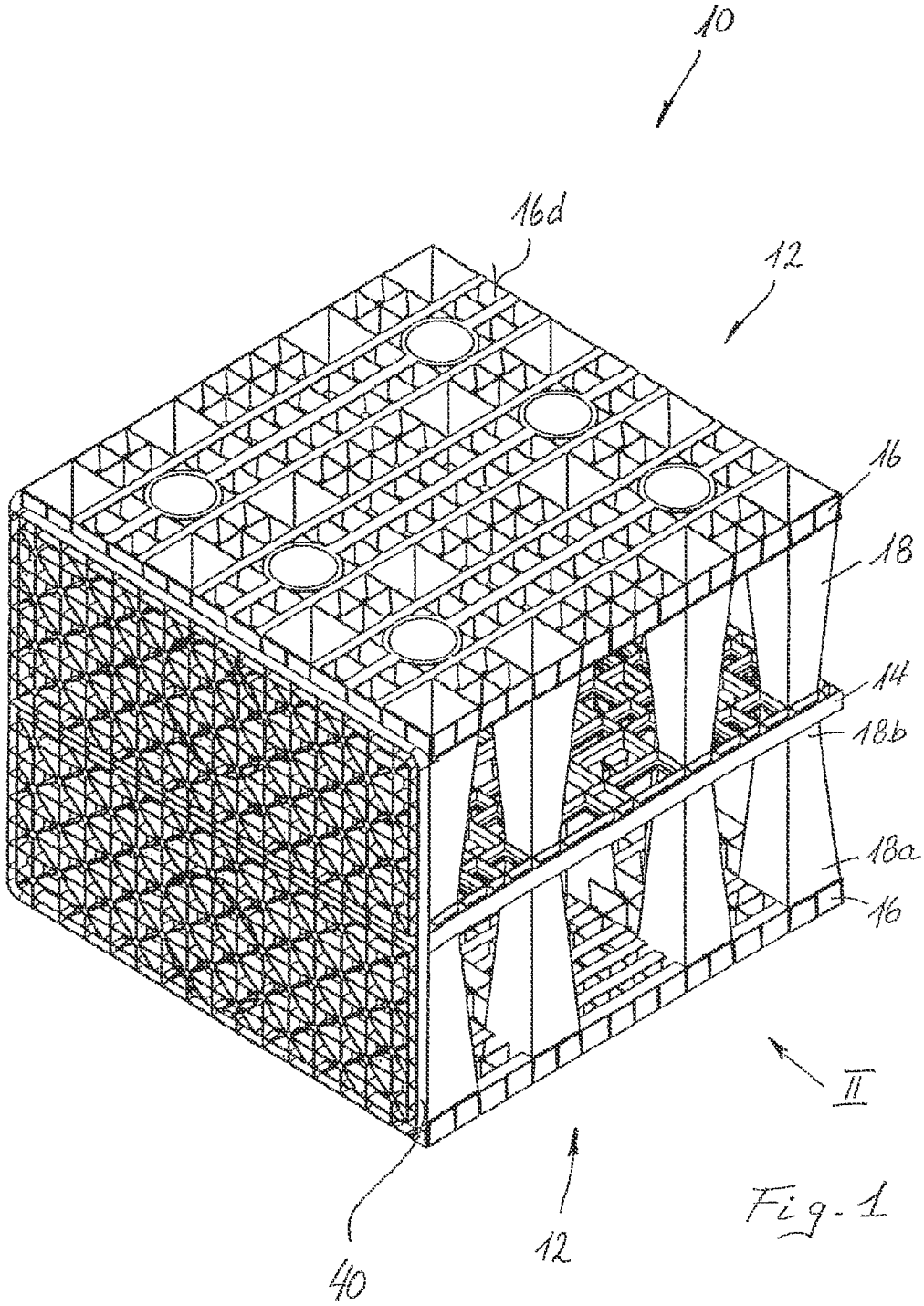

| | | | | |
|---|---|---|---|---|
| 2010/0200600 | A1* | 8/2010 | Hoekstra | E03F 5/101 220/676 |
| 2011/0108559 | A1* | 5/2011 | Hewing | E02B 11/005 220/694 |
| 2012/0255624 | A1* | 10/2012 | Canney et al. | 137/315.01 |

FOREIGN PATENT DOCUMENTS

| | | | | |
|---|---|---|---|---|
| EP | 2463449 | | 6/2012 | |
| JP | 2009013756 | | 1/2009 | |
| JP | WO 2011089690 | A1 * | 7/2011 | E03B 3/03 |
| WO | 2008140297 | A1 | 11/2008 | |
| WO | 2009137876 | | 11/2009 | |
| WO | 2010/095155 | | 8/2010 | |
| WO | 2011004508 | | 1/2011 | |
| WO | 2011042415 | | 4/2011 | |
| WO | 2011089690 | | 7/2011 | |

OTHER PUBLICATIONS

International Search Report of PCT/EP2012/072284 dated Jan. 23, 2013.

* cited by examiner

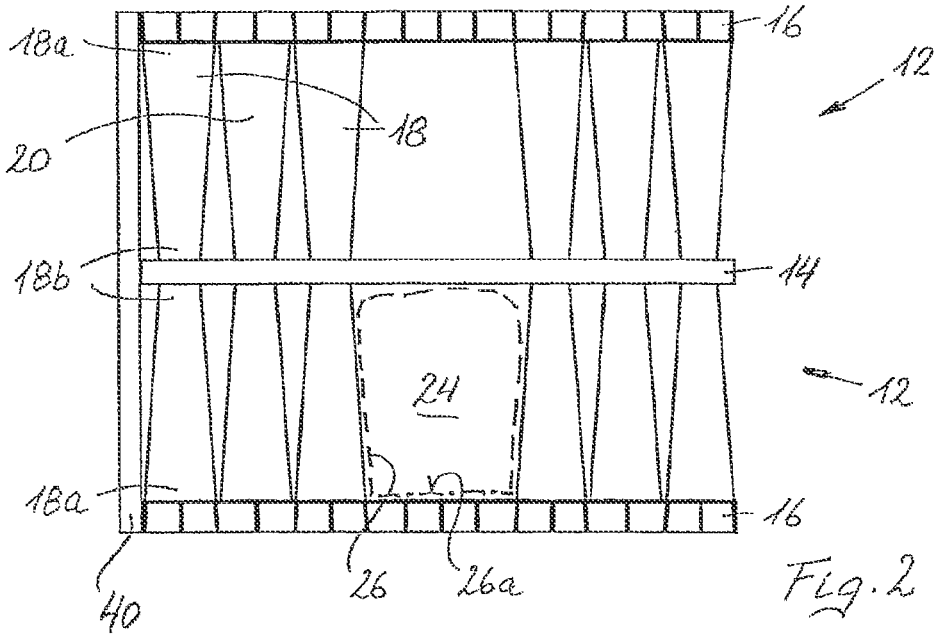
Fig. 2
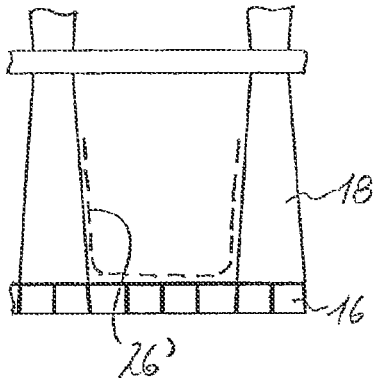
Fig. 2a
Fig. 2b
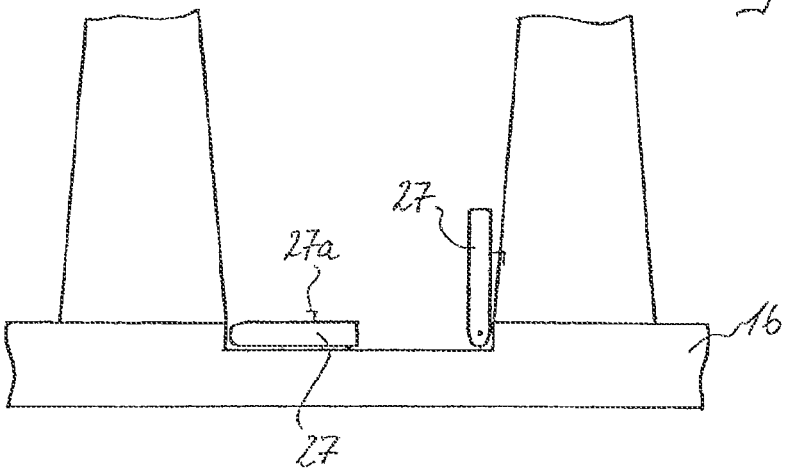

DRAINAGE TRENCH UNIT AND TRANSPORT UNIT FORMED FROM SUCH DRAINAGE TRENCH UNITS

The invention relates to the field of wastewater engineering in general terms.

Drainage trenches which are composed of a plurality of drainage trench units are increasingly being used, especially in larger towns and cities, for the purpose of disposing of surface water, such as rainwater for example. These drainage trenches form an underground water basin which is connected on the inlet side to at least one gully. The inlet may, however, also be formed by a rainwater pipe which feeds the rainwater collected on roof surfaces into the drainage trench. The rainwater collected on the sealed surface is in some cases supplied to the drainage trench by a feed system connected upstream of the drainage trench, said feed system possibly containing a facility to pre-clean the wastewater. The base area of the drainage trench may in this case be designed to be permeable to liquids so that the rainwater fed into said drainage trench can seep away into the underlying soil. On the outlet side, the drainage trench arrangement may be connected to the sewage system so that if the accruing quantity of rainwater exceeds the absorption capacity of the soil and the intake capacity of the drainage trench arrangement, backflowing onto the surface can be prevented.

EP 1 260 640 A1 as filed by the applicant discloses a rectangular drainage trench unit comprising two identical drainage trench sub-units, said drainage trench unit being ideally suited to forming such drainage trenches. One advantage of this drainage trench unit is that the volume of the drainage trench unit which can be used for water storage is very close to the total volume of the drainage trench unit. However, as the drainage trench units known in the art from EP 1 260 640 A1 are transported to the construction site in the ready-assembled state, this advantage may also simultaneously constitute a disadvantage, since the load-bearing capacity of the heavy goods vehicle used for transport purposes (jumbo class heavy goods vehicle with a load-bearing capacity of 14 t) can only be partially utilised although the loading volume is fully utilised. In the case of larger construction projects in particular, a large number of loads are thus required in order to transport the necessary number of drainage trench units to the construction site. This is obviously reflected in the price of the delivered drainage trench units.

In order to solve this problem the applicant has already proposed a drainage trench unit with drainage trench sub-units which can be arranged nested inside one another for transport to the construction site in German Patent Application 10 2010 028 607, which was still not published on the priority date of the present application. This solution does admittedly offer certain space-saving features, but ultimately could still not be entirely satisfactory.

Reference is also made to WO 2011/042 415 A1, JP 2002-115 278 A, and US 2009/0250369 A1.

The object of the present application is therefore also to provide a drainage trench unit which makes better use of both the loading volume and the load-bearing capacity of the heavy goods vehicles usually used for transporting said drainage trench units to the construction site.

This object is achieved according to a first aspect of the invention by a drainage trench unit which comprises at least one drainage trench sub-unit, at least one drainage trench sub-unit having a base wall and a plurality of hollow pillars which are connected integrally to the base wall and which taper, preferably conically, away from the base wall, i.e. tapering from their base end to their top end.

Due to the tapered form, the pillars from a plurality of drainage trench sub-units can be inserted inside one another for transport purposes so as to give a very compact transport arrangement overall, which makes effective use of the load-bearing capacity of the heavy goods vehicle whilst completely filling the loading volume.

It should be pointed out at this juncture that all direction, orientation or dimension-related details concerning the drainage trench sub-unit relate to a state of the drainage trench sub-unit in which the base wall of said drainage trench sub-unit runs horizontally and in which the pillars protrude upwards from the base wall. When referring to an inverted state of the drainage trench sub-unit in which the base wall runs horizontally and the pillars protrude downwards from said base wall, this will be mentioned explicitly.

As a development of the invention, in order to increase the compactness of the transport arrangement, it is proposed that the pillars should be designed and/or the wall thickness and/or degree of tapering or the conical angle of the pillars should be dimensioned such that, when two drainage trench sub-units with the same orientation and identical forms are stacked inside one another, the spacing between the base walls of the two drainage trench sub-units is less than the thickness of the base wall, preferably less than half the thickness of the base wall, it being even more preferable if the base walls of the two drainage trench sub-units lie against one another. The spacing between the base walls is understood to mean the distance between the upper surface of the base wall of the lower drainage trench sub-unit in the direction of stacking and the lower surface of the base wall of the upper drainage trench sub-unit in the direction of stacking. In contrast, the thickness or height of the base wall refers to the distance between the upper surface and lower surface of the base wall in one and the same drainage trench sub-unit.

So as not to impair the stackability of the drainage trench sub-units, the invention also proposes that the spaces between adjacent pillars should be free of these connecting elements, and especially free of connecting walls.

So that forces applied to the drainage trench unit in the horizontal direction can be transmitted by the drainage trench unit to adjacent drainage trench units, said adjacent drainage trench units need to be in lateral contact with each other. The drainage trench units according to the invention achieve this with the peripheral surfaces of their base walls. For this reason it is advantageous to design the peripheral surface of the base wall of the drainage trench unit as tall as possible. On the other hand, with regard to the desire to make savings in materials and thus costs, it is also desirable to design the base wall such that it is only as tall or thick as is necessary in order to achieve the stability required for the respective purpose. A third aspect to be considered is the load-bearing capacity of the heavy goods vehicles used for transportation to the construction site. In the light of interaction between these three aspects, it has been shown to be advantageous if the peripheral wall of the base area is designed to be higher than the remaining base wall. In particular, it is proposed that the base wall should comprise a peripheral surface which extends over more than 50% of the periphery of the base wall for a pre-defined distance over and above the remaining surface of the base wall, the pre-defined distance being less than the thickness of the base wall, for example, preferably less than half the thickness of the base wall. The base wall may be 5 cm tall, for example, whilst the remaining base wall may be 4 cm tall or thick. It is of course possible to provide a transition region falling obliquely away towards the remaining base wall between the peripheral surface of the base wall and the remaining base wall.

In order to increase the tilting stability of the pillars, it is a known procedure to provide a plurality of reinforcing ribs in the transition region between the base end of at least one pillar and the base wall, said reinforcing ribs preferably being arranged and distributed over the entire periphery of the pillar. So that the stackability of the drainage trench sub-units is not impaired by these reinforcing ribs, a development of the invention proposes that lateral reinforcing ribs, which support at least one pillar, preferably a plurality of pillars, or even more preferably all pillars, at their base end and prevent them from tilting, extend merely within the height of the base wall.

Peripheral and corner pillars may also be provided such that they have a pre-defined spacing from the edge of the base wall. This pre-defined spacing, which may, for example, range between approximately 1 cm and approximately 5 cm, means that sufficient installation space is also available in the edge region of the base wall to be able to arrange the reinforcing ribs such that they are distributed over the entire periphery even in the presence of peripheral and corner pillars.

In order to increase the stability of the pillars even close to their top end, but without impairing the stackability of the drainage trench sub-units, it is proposed that the inner space of the plurality of pillars should, if necessary, comprise reinforcing elements, for example reinforcing struts, at a level adjacent to the top end, the height of said level corresponding to the thickness of the base wall. However, it is also conceivable to design the pillars such that they are completely hollow.

Furthermore, it is conceivable that at least one pillar should comprise two cones arranged inside one another, the taper directions of said cones running in the opposite direction to one another, the largest diameter of the inner cone having dimensions which are no larger than the smallest diameter of the outer cone. In this case it is also possible for the two cones arranged inside one another to be joined together, preferably connected integrally, at the point where the inner cone has the largest diameter and the outer cone has the smallest diameter, for example by a ring wall running parallel to the base wall or a plurality of webs running parallel to the base wall.

In a development of the invention it is proposed that the pillars should have a substantially constant wall thickness over their entire height. Such pillars can be constructed in a particularly simple manner.

Alternatively, however, it is also conceivable that the wall thickness of the pillars may vary from their base end to their top end, preferably increasing from their base end to their top end. The resistance of a pillar to forces applied to said pillar in the vertical direction is dependent, in the case of the pre-defined pillar material, on the cross-sectional area of the pillar at the level at which the pillar has the smallest cross-sectional area. This is the top end of the pillar in the case of a pillar which tapers conically. The wall thickness of the pillar can therefore be varied, for example from its top end to its base end and in such a way that the cross-sectional area at any pillar level is not smaller that the cross-sectional area at the top end of the pillar.

Additionally or alternatively, it is also conceivable that at least one reinforcing rib may be provided on the outer surface and/or the inner surface of at least one pillar, the radial height of the at least one reinforcing rib advantageously varying from the base end to the top end of the pillar, preferably increasing from the base end to the top end. In addition, the at least one reinforcing rib may only extend over part of the height of the pillar.

The dependence of the resistance of a pillar to forces applied to said pillar in the vertical direction, as explained above, on its minimum cross-sectional area also opens up the possibility for the peripheral wall of at least one pillar, preferably all pillars, to comprise at least one opening which allows liquid to pass through. In this manner liquid can pass from the outer environment of the respective pillar into its inner space and vice versa, so that the inner space of the pillar(s) can be fully utilised to store water.

In addition, this can prevent the formation of air chambers which generate lift forces and could thus jeopardise the stability of the drainage trench overall. In this case it is also advantageous if the at least one opening is arranged nearer to the base end of the pillar than to its top end, or is preferably arranged adjacent to its base end, as the pillar has the largest diameter at this point.

Additionally or alternatively, the end face of the top end and/or the base end of at least one pillar, preferably each pillar, said end face running at right angles to the vertical direction of the pillar, may comprise at least one opening which allows liquid to pass through. Regardless of the orientation of the lowermost drainage trench sub-unit of a plurality of drainage trench sub-units arranged on top of one another, these openings can reliably ensure that even the inner space of the pillar of the lowermost drainage trench sub-unit is able to drain completely.

In order to facilitate the distribution of water in the drainage trench, a development of the invention proposes that the base wall should be designed as a lattice structure, at least in part, preferably substantially completely.

In this case at least a portion of the lattice webs forming the lattice structure, preferably over 50% of these lattice webs, or even more preferably all of these lattice webs, should be in the form of strips. In this case the feature defining the strip formation is regarded as the fact that they are longer and wider than they are thick, their thickness preferably being less than one third, or even more preferably less than one fifth of the smaller of the two length and width dimensions. With regard to the stability of the base wall and penetration by water, it is also advantageous if the thickness dimension and the length dimension run in the extension plane of the base wall, whilst the width dimension runs at right angles to this plane.

As is known per se, it is also conceivable in the case of the drainage trench sub-unit according to the invention for the base wall to comprise a base area which is substantially square. In principle, the base area of the base wall may, however, also have a different shape, for example, a rectangular shape, especially a rectangular shape with an area composed of two square sub-areas. However, a triangular shape, a trapezoidal shape or even a honeycomb shape are also conceivable, to name but a few further examples.

In order to utilise the loading volume of heavy goods vehicles to an optimum extent, especially the width of the loading area of said heavy goods vehicles, it is proposed that the edge length of the base wall in the longitudinal direction and/or in the width direction is less than 90 cm, preferably 80 cm±1 cm.

To allow the drainage trench unit according to the invention, which preferably comprises two drainage trench sub-units which are arranged such that they are inverted with respect to one another, i.e. two drainage trench sub-units which are connected to each other with their pillars pointing towards one another, to also be used in combination with the traditional drainage trench sub-units which are marketed by the applicant under the name "Rigofill inspect" and which are approximately 66 cm tall, it is proposed that the height of the drainage trench sub-unit should be substantially 33 cm or substantially 22 cm or substantially 16.5 cm. The words "substantially" are intended to mean tolerances of the order of ±1.0 cm, preferably ±0.5 cm. According to the first alternative, the drainage trench unit composed of two such drainage trench sub-units is the same height as the traditional drainage trench unit. According to the third alternative, two drainage trench units are required, i.e. four drainage trench sub-units, to represent the same height. And according to the second alternative the height of three drainage trench units according to the invention corresponds to the height of two traditional drainage trench units.

As a general rule the plurality of pillars can be arranged in any configuration, distributed over the base area of the base wall, provided that it is ensured that the requirements imposed on the drainage trench unit, especially with regard to vertical load-bearing capacity, are fulfilled.

For example, the pillars can be arranged in a grid with a plurality of pillar rows and a plurality of pillar columns, each pillar being assigned to one pillar row and one pillar column, and the spacing between at least one pair of adjacent pillar rows and/or pillar columns is larger than the spacings between other pillar rows or pillar columns which are adjacent to one another. The intermediate space between pairs of adjacent pillar rows and/or pillar columns can in this case be used as an inspection passage through which an inspection device can be inserted into the drainage trench, for example a mobile camera for visual inspection of the state of the drainage trench or a high-pressure cleaning lance for cleaning the drainage trench, said lance spraying pressurised cleaning water into the drainage trench from one or more nozzles.

If the peripheral surface of the base wall, as proposed above for a development of the invention, is higher in comparison with the remaining base wall, it is advantageous for the purpose of transferring the inspection device from drainage trench unit to drainage trench unit if the peripheral surface of the base wall is substantially the same height as the remaining base wall at two opposite portions which are assigned to opposite side edges of the base wall. These portions which are lower than the peripheral surface can also be used as recessed grips when the drainage trench sub-units are in the stacked transport state, said recessed grips making it easier to take hold of a drainage trench sub-unit and detach it from the stack.

According to a first embodiment, the pillars or the pillars of a first group of pillars may, for example, be arranged in a 4×4 grid, i.e. in a grid with four pillar rows and four pillar columns, each pillar being assigned to a pillar row and a pillar column.

In this case the pillars or the pillars in the first group of pillars are arranged at regular spacings from each other. In this case, once again, the passages between adjacent pillar rows can be used as inspection passages.

However, for use as an inspection passage, it is advantageous if the spacing between the adjacent pillar rows and/or pillar columns forming this inspection passage is larger than the spacings between the other pillar rows or pillar columns which are adjacent to one another. For example, the spacing between the second pillar row/pillar column and the third pillar row/pillar column may be larger than the spacing between the first pillar row/pillar column and the second pillar row/pillar column and/or the spacing between the third pillar row/pillar column and the fourth pillar row/pillar column.

In this case the spacing between the adjacent pillar rows or pillar columns measured at the height of the upper side of the base wall, said pillar rows or pillar columns bordering the inspection passage, is at least 20 cm, preferably at least 15 cm. These dimensions provide a sufficiently wide channel to allow the inspection device to be inserted through the inspection passage thus formed into the drainage trench, for example a mobile camera for visual inspection of the state of the drainage trench or a high-pressure cleaning lance for cleaning the drainage trench, said lance spraying pressurised cleaning water into the drainage trench from one or more nozzles.

In quite general terms, i.e. not merely in connection with a specific number and/or arrangement of pillars, the inspection passage is used for visual inspection of the state of the drainage trench, i.e. not only of the inspection passage itself, but also the water uptake volumes adjacent to said passage, for example with a mobile camera, and/or for cleaning the drainage trench, for example, with a high-pressure cleaning lance which sprays pressurised cleaning water into the drainage trench from one or more nozzles, i.e. not only into the inspection passage, but also into the water uptake volumes adjacent to said passage. In the visual inspection, it is particularly important to be able to inspect the clogging state of the base areas of the water uptake volumes adjacent to the inspection passage, as sediment tends to be deposited in this area rather than on the side surfaces. Likewise, when cleaning, it is particularly important to also whirl up the sediment deposited on the base areas in the water uptake volumes adjacent to the inspection passage with cleaning water and to also be able to give the cleaning water containing the whirled-up sediment a pre-defined flow direction if desired, so as to make it easier to extract the sediment, for example from a shaft connected to the inspection passage.

As the drainage trench sub-units are only assembled to form drainage trench units on the construction site and it must be assumed that this work is carried out by trained auxiliary staff, it is advantageous if any opportunities for assembly errors are excluded in design terms from the start. In the present case, it is therefore particularly advantageous if the assembly worker does not need to worry about the orientation of the drainage trench units during assembly. For this reason, in order to provide an inspection passage, it is proposed that the drainage trench sub-unit should comprise an inspection passage in both main directions. For example, the spacing between the second pillar and the third pillar in each pillar row or pillar column in the 4×4 grid may be larger than the spacing between the first pillar and the second pillar of each pillar row or pillar column and/or the spacing between the third pillar and the fourth pillar in each pillar row or pillar column.

In order to increase the stability of the drainage trench sub-unit or the drainage trench unit formed from two such drainage trench sub-units, especially with respect to forces applied to said units in the vertical direction, a second group of pillars may also be provided, each pillar in the said second group of pillars being arranged between four pillars from the first groups of pillars which are adjacent to one another. In order to provide the inspection passages, it is advantageous if pillars from the second group of pillars are not arranged between those pillars in the first group of pillars which belong to pillar rows or pillar columns which border an inspection passage.

For example, the pillars from the second group of pillars may form a 3×3 grid; i.e. a grid with three pillar rows, each row comprising three pillars, the closest neighbours of each pillar in the second group of pillars being the four pillars of the first group of pillars. However, in a development of the invention, with regard to providing an inspection passage, it is proposed that the pillars of a second group of pillars should be arranged in two rows, each with three pillars, each pillar in the second group of pillars being arranged between four pillars which are adjacent to one another in the first groups of pillars, and none of the pillars in the first group of pillars being adjacent to two pillars from the second group of pillars which belong to different pillar rows.

Once again in this case, the stability of the drainage trench unit with respect to vertical forces can be improved, for example by arranging the pillars of a second group of pillars in a 2×2 grid, i.e. in a grid with two pillar rows, each row comprising two pillars, each pillar in the second group of pillars being arranged between four pillars which are adjacent to one another in the first groups of pillars, and one of the four pillars in the first group of pillars being a corner pillar of the 4×4 grid in each case, or none of the four pillars in the first group of pillars being adjacent to two pillars from the second group of pillars.

According to a second embodiment, it may, however, also be proposed that the pillars or the pillars of a first group of pillars are arranged in a 3×3 grid, i.e. in a grid with three pillar rows each row comprising three pillars.

If desired, in order to increase the stability of the drainage trench sub-unit or the drainage trench unit formed from two such drainage trench sub-units, especially with respect to forces applied to said units in the vertical direction, a second group of pillars may also be provided, forming a 2×2 grid, i.e. a grid with two pillar rows, each comprising two pillars, the nearest neighbours of each pillar in the second group of pillars being the four pillars in the first group of pillars.

According to a third embodiment, it may, however, also be proposed that the pillars or the pillars of a first group of pillars are arranged in a 5×5 grid, i.e. in a grid with five pillar rows, each row comprising five pillars.

If desired, in order to increase the stability of the drainage trench sub-unit or the drainage trench unit formed from two such drainage trench sub-units, especially with respect to forces applied to said units in the vertical direction, a second group of pillars may also be provided, forming a 4×4 grid, i.e. a grid with four pillar rows, each comprising four pillars, the nearest neighbours of each pillar in the second group of pillars being the four pillars in the first group of pillars.

Like the embodiment with a first group of pillars arranged in a 4×4 grid, an inspection passage can also be provided in those embodiments with pillars from the first group of pillars being arranged in a 5×5 grid or a 3×3 grid, by not providing any pillars in one of the pillar rows and/or pillar columns from the second group of pillars and thus leaving a free passage between two adjacent pillar rows and/or pillar columns in the first group of pillars. In this case the spacing between the pillar rows or pillar columns bordering this passage, as measured at the height of the upper side of the base wall, may be at least 20 cm, preferably at least 15 cm.

In order to provide a gangway for the above-mentioned inspection device, a development of the invention proposes that a surface portion of the base wall arranged between two adjacent pillar rows, said portion extending from a side edge of the base wall to its opposite side edge, is designed as a support surface, i.e. a maximum of 50%, preferably a maximum of 25%, of its surface is breached by openings, preferably longitudinal slots, said slots running in a longitudinal direction which is preferably at right angles to the connection direction of the two side edges. In this case the width of the surface portion may be at least 50%, preferably at least 75%, or even more preferably substantially 100% of the spacing between the base ends of the adjacent pillar rows at the height of the base wall.

The pillars do not all need to have the same cross-sectional shape. For example, it is conceivable to provide both pillars with a circular base area and pillars with a square base area. However, base areas with quite different shapes are also conceivable, such as a star-shaped base area for example.

For example, at least one pillar, preferably a plurality of pillars, even more preferably all pillars, may have a cruciform cross-section, the outline of the cruciform cross-section being designed such that it has the following features: on the one hand, it runs partly along the outline of a square, the side edges of said square running in parallel with the side edges of the base wall, and partly inside the outline of this square, but not outside the outline of this square. On the other hand, one portion of the outline of the cruciform cross-section, which is assigned to at least one corner, preferably all corners, of this square, runs between a first outline point of the square and a second outline point of the square inside the outline of the square. In this case this portion of the outline of the cruciform cross-section runs inside a connecting straight line between the first and second outline points of the square and outside or if necessary on a connecting line which has two rectilinear portions, each of said rectilinear portions departing from either the first or second outline points of the square and running at right angles to the side edge on which the respective outline point is located. Furthermore, this portion of the outline of the cruciform cross-section is preferably shorter than the connecting line. Thanks to this configuration of the pillar cross-section, the openings in the pillars do not need to be sealed on the surface of the base wall facing away from the pillars by means of separate cover elements in order to allow assembly staff to walk on drainage trench units which are already installed with substantially no risks. Thanks to the "indentations" in the outline of the cruciform cross-section in the region of the corners of the imaginary square used in the above description of the outline shape, the free lengths of the pillar cross-sectional area are shortened such that they no longer pose trip hazards for the feet of assembly staff. This is particularly relevant if the imaginary square has sides which are a maximum of 12 cm long, preferably a maximum of 11 cm, or even more preferably a maximum of 10 cm. In addition, "indentations" in the region of the corners of the imaginary square, which are formed in accordance with the above features, do not extend the peripheral length and thus the materials used compared with a pillar with a cross-section corresponding to the imaginary square, but, instead, lead to a shorter peripheral length which thus requires less material.

In a development of the invention, it is proposed that at least one pillar, preferably at least one peripheral pillar, should comprise at least one planar peripheral wall surface portion. For example, the pillars in the first group of pillars could be pillars with a square base area, whilst the pillars in the second group of pillars could be pillars with a circular base area. In particular, in order to adapt to the edges of the base wall, which usually run in a straight line, the peripheral pillars may in particular comprise at least one planar peripheral wall surface portion. It is evident that in this case at least one corner pillar may comprise two planar peripheral wall surface portions.

In order to facilitate the work of the staff assembling the drainage trench from the drainage trench units, it is proposed that the surface of the base wall facing away from the pillars should be designed such that two drainage trench sub-units with an identical design and oriented inversely with respect to each other in the vertical direction may be connected to each other in the horizontal direction so that they do not move. This can, for example, be achieved by designing the surface of the base wall facing away from the pillars with at least one protrusion and at least one recess such that two drainage trench sub-units with an identical design and oriented inversely with respect to each other in the vertical direction can be arranged such that they interlock positively with each other in the horizontal direction.

In addition, or alternatively, however, it is also conceivable that the surface of the base wall facing away from the pillars may be designed such that two drainage trench sub-units with an identical design and oriented inversely with respect to each other in the vertical direction may be connected to each other positively in the horizontal direction by means of at least one connecting element.

In this case, positive locking in the horizontal direction in both cases does not exclude the possibility that there is also a positive connection in the vertical direction, i.e. that the drainage trench sub-units can also be latched together, for example.

It is preferable for the drainage trench unit to comprise two drainage trench sub-units which are arranged with the top ends of their pillars pointing towards one another, and preferably connected together at the associated top ends of pillars belonging to different drainage trench sub-units.

With this inverted arrangement of the two drainage trench sub-units, the base wall of one of the drainage trench sub-units forms the base wall of the drainage trench unit, whilst the base wall of the other drainage trench sub-unit forms the top wall of the drainage trench unit.

In order to provide a stable drainage trench unit with regard to the forces applied to said unit in the horizontal direction, it is proposed that a preferably plate-shaped intermediate element should be arranged between the two drainage trench sub-units, said intermediate element connecting the top ends of the pillars of both drainage trench sub-units. This intermediate element is preferably positioned halfway up between the two base walls of the drainage trench sub-units, which means that the free supporting length of the pillars assigned to form a pair of pillars is halved. However, as the intermediate element does not just connect the top ends of the pillars in a pair of pillars, each of which belongs to a different drainage trench sub-unit, but also the top ends of pillars belonging to one and the same drainage trench sub-unit, any lateral forces applied to one of the pillars, for example lateral soil pressure forces, do not need to be taken up by this pillar alone, but can also be transmitted via the intermediate element to the other pillars in the drainage trench unit or to the opposite side of the drainage trench. This results in an arrangement which is more stable overall.

So that the intermediate element can also be used to transmit horizontal forces from drainage trench unit to drainage trench unit, a development of the invention proposes that the intermediate element should at least in part have substantially the same dimensions as the base wall of the drainage trench sub-units in at least one of its main extension directions, i.e. in its longitudinal extension and/or in its width extension. The intermediate element is preferably substantially the same length and/or width as the base wall of the drainage trench sub-units. As a result of this design, not only do the base walls of adjacent drainage trench units lie against one another laterally so that they can transmit horizontal forces from drainage trench unit to drainage trench unit, but this also applies to their intermediate elements.

If the base walls of the drainage trench sub-units protrude laterally beyond the peripheral and corner pillars over a pre-defined spacing, then this also applies to the intermediate element in accordance with the dimension rule discussed above. For term definition purposes, it should be pointed out at this juncture that the intermediate elements, which are known from the drainage trench unit marketed by the applicant under the name of "Rigofill inspect", do not protrude laterally beyond the pillars as described in the present invention, as, in these drainage trench units, the peripheral or corner pillars finish flush with the edge of the base walls and the intermediate element. This does not alter the fact that the pillars engage in recesses of the intermediate element with end fittings which are slightly set back, the boundary edge of said recesses thus having a dimension which is only slightly larger than the fittings.

The sub-division of the free length between the two base walls by the intermediate element which is associated with the "protrusion" of the intermediate element beyond the pillars, as described above, and not merely beyond the top end of said pillars, but also beyond their base end, increases the protection of the pillars from forces applied both laterally and horizontally. Transmission of horizontal forces and vertical forces can also be separated from each other in this manner. Whilst vertical forces are transmitted by the pillars, horizontal forces are transmitted by the base walls and the intermediate elements. With regard to horizontal forces, and in particular transmission of said forces from drainage trench unit to drainage trench unit within the drainage trench, the pillars merely serve to provide transverse stiffness between the individual layers of base walls and, if applicable, intermediate elements. Separating vertical and horizontal forces is, for example, advantageous because it can prevent overloading of individual pillars, which might lead to these pillars buckling, especially in the case of peripheral or corner pillars of a drainage trench unit which is also arranged at the edges or corners of the drainage trench as a whole. Furthermore, horizontal forces which cause the pillars to tilt may have an adverse effect on the vertical load-bearing capacity of the drainage trench unit, as pillars which are arranged obliquely have a lower load-bearing capacity than vertical pillars with the same structure.

As there are always applications in which a drainage trench unit which is only half the height of the drainage trench unit described above, which is formed from two drainage trench sub-units, is advantageous, it is also conceivable that the drainage trench unit may be formed from a single drainage trench sub-unit and the intermediate element. In this case, for example, the intermediate element forms the top wall of the drainage trench unit, whilst the base wall of the drainage trench sub-unit forms the base wall of the drainage trench unit. However, as a general rule it is also conceivable that the intermediate element may form the base wall of the drainage trench unit, whilst the base wall of the drainage trench sub-unit forms the top wall of the drainage trench unit.

As using the intermediate element as the base and/or top wall of the half-height drainage trench unit is associated with specific requirements, it can be advantageous to design the intermediate element such that it satisfies these requirements, or to provide a separate base element and/or top element which satisfies these structural requirements instead of the intermediate element.

The development opportunities described above for the intermediate element of the two drainage trench sub-units and the drainage trench unit comprising the intermediate element also apply in identical terms to the intermediate element and/or the base element and/or the top element of this half-height drainage trench unit.

In order to also position this half-height drainage trench unit in the bottommost layer of the drainage trench and also to provide an inspection passage at this point, especially if the intermediate element forms the base wall of the drainage trench unit, whilst the base wall of the drainage trench sub-unit forms the top wall of the drainage trench unit, it is also proposed that a surface portion arranged between two adjacent pillar rows, said surface portion extending from one edge of the intermediate element to the opposite edge of said intermediate element, is designed as a support surface, i.e. a maximum of 50%, preferably a maximum of 25%, of its surface is breached by openings, preferably by longitudinal slots, the longitudinal direction of said slots preferably running at right angles to the connection direction of the two edges. In this case the width of the surface portion may be at least 50%, preferably at least 75%, or even more preferably substantially 100% of the spacing between the base ends of the adjacent pillar rows at the height of the base wall.

In order to allow liquid to pass through, the intermediate element may be at least partially designed as a lattice structure. In this case, the comments made in respect of the lattice webs forming the lattice structure of the base wall apply in identical terms to the lattice webs forming the lattice structure of the intermediate element.

In order to connect the top ends of the pillars in both drainage trench sub-units, the intermediate element may comprise recesses both in its upper surface and in its lower surface for receiving the top ends of the pillars of the two drainage trench sub-units. In this case, the top ends of the pillars may engage preferably over a maximum depth of 2 cm, or even more preferably over a maximum depth of 1.5 cm, in the recesses assigned to said top ends.

In order to increase stability, it may also be proposed that the top end of at least one pillar, preferably a plurality of pillars, or even more preferably all pillars, may also be latched in the associated recess.

In order to realise this latching function in simple design terms in this case, it is proposed that the top end of at least one pillar should comprise a collar protruding radially inwards, with which a latching element protruding from the base of the recess can be latched. The spring action of the latching element may in this case easily be selected such that the forces required for local manual assembly on the construction site are not considerable.

With reference to the injection moulding process preferred for manufacture, and to ensure that the recesses can be produced without any problems when unmoulding the intermediate element, it is proposed that the recesses should be cylindrical in shape, and specifically in the shape of a cylinder, the lateral surface of which runs at right angles to the curve producing the cylinder.

At least one rib element, preferably a plurality of rib elements, protruding radially inwards from the inner wall of at least one recess, preferably all recesses, said rib element/s being preferably formed at an incline, may in this case also be provided. On the one hand, the rib elements may serve to surround the top ends of the pillars in the horizontal direction by friction such that horizontal forces can be transmitted reliably. On the other hand, they may also serve to centre the top ends in the recesses, so as to ensure that the opposite top ends of the two drainage trench sub-units overlap each other as completely as possible in the vertical direction with regard to reliable transmission of vertical forces.

In order to create a positive connection in the vertical direction between the drainage trench sub-units forming a drainage trench unit without any further auxiliary aids, for example without an intermediate element, a first quantity of pillars, preferably half the pillars, may also comprise male connecting elements at their top ends, whilst a second quantity of pillars, preferably the other half of the pillars, may comprise female connecting elements at their top ends, the pillars in the first quantity of pillars and the pillars in the second quantity of pillars being arranged such that two identically formed drainage trench sub-units arranged inversely with respect to each other in the vertical direction can be brought together so that pillars with male connecting elements, preferably all pillars with male connecting elements, each engage and connect with a pillar with female connecting elements. This type of connection, which is known per se from EP 0 943 737 B1, has the disadvantage that the two drainage trench sub-units can merely be connected to each other in two of the four possible relative positions by twisting around an axis running at right angles to the base wall.

A further option is for the top ends of the pillars of a first drainage trench sub-unit to be designed with male connecting elements and the top ends of the pillars in a second drainage trench sub-unit to be designed with female connecting elements. When using the injection moulding process to manufacture the drainage trench sub-units, a single injection moulding tool is sufficient, however, as the difference between a top end with a male connecting element and a top end with a female connecting element can be created by a moulding insert which is inserted in the injection mould in one case and not in the other.

Irrespective of whether the base area of the inspection passage is formed by the base wall of a drainage trench sub-unit or by the intermediate element, the inspection device can, for example, be safety guided in the inspection passage by the fact that the drainage trench unit also comprises a tunnel element which can be fastened on the base wall or the intermediate element in a "reverse U-shape" configuration, the tunnel element comprising openings through which liquid can pass, for example, said tunnel element being preferably equipped, at least in part, with a lattice structure.

Alternatively or in addition to the configuration of the gangway on the base wall of the drainage trench sub-unit or the intermediate element, it is also possible for the tunnel element to be fastened on the base wall or the intermediate element in a "lateral horizontal D-shaped" configuration, the linear web of the D-shape running substantially parallel to the surface of the base wall or the intermediate element.

As a further alternative, the tunnel element may be designed to be substantially "U-shaped", the bottom leg of the U-shape running substantially parallel to the surface of the base wall or the intermediate element. In addition, at least one of the legs of the U-shape may be able to fastened on the base wall or the intermediate element.

In order to provide the tunnel element, which may, for example, be designed as a formable sheet, with dimensional stability, it is also proposed that the lattice tunnel element should lie on the sides of the pillars of the two adjacent pillar rows and, if necessary, above the intermediate element or the base wall.

However, alternatively or in addition to the tunnel element, two or more separate boundary elements may also be provided to define the lateral limits of the inspection passage. These boundary elements may, for example, be articulated on the base wall or the intermediate element such that they can pivot and be able to be pivoted between a position which runs substantially parallel to the base wall or the intermediate element and an upright position. The pivotable articulation mechanism may be formed as an integral hinge or as a result of elements which engage with each other like teeth and which are connected to one another by means of a pivot pin. However, as a general rule it is also conceivable to design the boundary elements as plug-in components which can be connected to the base wall and/or the pillars bordering the inspection passage by means of plug-in connections.

Thanks to the guide means provided by the tunnel element or the boundary elements for the inspection device, the inspection passage becomes an inspection channel in which the inspection device can move safely without incurring any risk of getting caught between the pillars.

Like the tunnel element, the boundary elements may also comprise openings allowing liquid to pass through, preferably at least in parts, and advantageously provided with a lattice structure adjacent to the upper side of the base wall or the intermediate element. At least part of the lattice webs of the lattice structure of the tunnel element and/or the boundary elements may in this case be designed such that they divert at least part of the water ejected by a cleaning device on passing through the lattice structure such that a flow with a flow component running parallel to the extension direction of the inspection channel arises in the water uptake volumes of the drainage trench unit adjacent to the inspection channel. As a result of this flow component, the sediment whirled up by the cleaning water can be moved towards an inspection shaft, which provides access to the inspection channel and can be extracted in a simple manner from here. The said flow component may, for example, be achieved by inclining part of the lattice webs with respect to a direction running transversely to the inspection channel. Otherwise, the comments above concerning the formation of the lattice structure of the base wall and/or the intermediate element also apply to the lattice webs of the lattice structure of the tunnel element and/or the boundary elements.

As an alternative to using the above-mentioned tunnel and/or boundary elements, it is also possible to ensure that the inspection device is guided safely by additional attachments on the inspection device itself, for example lateral guide elements. The use of such lateral guide elements, especially guide rails, is known per se from the inspection of full-wall pipes with an oval cross-section. However, the guide elements fitted to the side of the inspection device have a different role in this application, notably to guarantee that the inspection device is oriented in an upright position in the pipe despite the fact that the inspection device stands up on both lateral sides of the steep walls of the oval pipe. This problem does not arise with the drainage trench elements according to the invention. However, the inventors have recognised that the guide elements which belong to the standard accessories for inspection devices with regard to pipes with an oval cross-section are also suited to keeping the inspection device on its route between the pillar rows or columns without incurring any risk of getting caught between the pillars. For this reason, the use of an inspection device equipped with lateral guide elements for inspection of a drainage trench composed of a plurality of drainage trench units according to the invention, particularly by moving the inspection device in the space between a pair of adjacent pillar rows and/or pillar columns of the drainage trench units, said pair of pillar rows or columns having a greater spacing than the spacings between other pillar rows or pillar columns which are adjacent to one another is deemed worthy of special protection.

In order to prevent intermediate elements stacked on top of one another slipping sideways when transporting the intermediate elements, it is proposed that the intermediate element should comprise at least one pair of corresponding holding elements on its upper side and its lower side, notably at least one protrusion and at least one recess which is positioned accordingly.

In order to provide the drainage trench with a support surface on its outer surface, for example for a geotextile, a development of the invention proposes that the drainage trench unit should also comprise at least one side end element which is designed to be permeable to liquid, and, for example, is at least partially designed as a lattice structure. In this case, the comments made in respect of the lattice webs forming the lattice structure of the base wall apply in identical terms to the lattice structure of the lattice webs forming the side end element.

The at least one side end element may, for example, extend over the entire height of a drainage trench unit, which is formed by two drainage trench sub-units oriented inversely with respect to one another. In this case, the side end element may only be supported laterally on the base walls of two drainage trench sub-units which are oriented inversely with respect to one another. This is the case, for example, if the drainage trench unit does not have an intermediate element or the intermediate element is designed to be smaller than the base wall of the drainage trench sub-units.

However, it is also possible that the side end element is only supported laterally on the base walls of two drainage trench sub-units which are oriented inversely with respect to one another and an intermediate element positioned between said drainage trench sub-units. In this embodiment, horizontal forces can also be applied to the intermediate element in a particularly effective manner.

In the case of the above-mentioned half-height drainage trench unit in particular, the side end element may also be provided such that it is only supported laterally on the base walls of a drainage trench sub-unit and an intermediate element assigned to said drainage trench sub-unit. However, in principle it is also conceivable that a drainage trench unit comprising two drainage trench sub-units may be equipped with two such side end elements at its sides.

In other words, it is preferable for the side end elements to be free of any lateral contact with the pillars of the drainage trench sub-unit or the drainage trench sub-units.

Thanks to the fact that the side end element is only supported laterally on the base wall or the two base walls and, if desired, on the intermediate element, the side end element is also unable to apply any horizontal forces to the peripheral and corner pillars, which has the advantages mentioned above.

In order to connect the side end element to the drainage trench unit in a simple manner, it is proposed that the side end element should comprise latching elements which can be latched in corresponding latching recesses in the side wall of the base walls of the two drainage trench sub-units or the base wall of the drainage trench sub-unit and the intermediate element.

So as to further simplify assembly of the side end element on the drainage trench unit, it is also proposed in this case that at least one latching element and the corresponding latching recess should be simultaneously designed as pivot bearings. In this case, the side end element can notably be positioned with the latching element designed as a pivot bearing in a slightly oblique position relative to the drainage trench unit on the assigned latching point on the base wall of a drainage trench sub-unit or on the intermediate element and then pivoted around this pivot bearing towards the drainage trench unit and latched with said drainage trench unit on its opposite edge to the pivot bearing.

It should also be noted that the at least one drainage trench sub-unit and/or the intermediate element and/or the side end element are manufactured from plastics material, preferably as an injection moulded part, for example from polyethylene or polypropylene.

It should furthermore be noted that the relative storage capacity of the drainage trench unit, i.e. the ratio of the volume of the drainage trench unit which can be used for water storage to the overall volume of the drainage trench unit has a value of more than 90%, preferably more than 95%.

In order to transport the drainage trench units according to the invention to the construction site in a simple manner, a further aspect of the invention relates to a transport unit comprising at least one stack of drainage trench sub-units stacked on top of one another.

In order to transport the embodiment having an intermediate element, the stack or each of the stacks may in this case comprise an even number of drainage trench sub-units and half as many intermediate elements.

In this case, one of the intermediate elements may in particular advantageously form a base area of the stack, the even number of drainage trench sub-units and then the remaining intermediate elements being preferably arranged on the intermediate element used as the base area. As a result, on the one hand, the pillars of the bottommost drainage trench sub-unit can be protected from damage, for example due to buckling or damage to the top ends of the pillars, in the event of incorrect handling, especially during loading and unloading in the manufacturing plant and on the construction site. On the other hand, the height of the stack can be reduced accordingly by approximately half the height of an intermediate element if the drainage trench sub-units are stacked with the pillars pointing downwards.

If the drainage trench sub-units are 33 cm tall, the base walls being 3.8 cm tall and lying on top of one another in the stacked state, and if the intermediate elements are 2.8 cm tall, the stack will be approximately 132 cm tall if each of the stacks comprises twenty drainage trench sub-units and ten intermediate elements, so that two stacks positioned on top of one another make optimum usage of the loading height of standard heavy goods vehicles.

In order to transport the embodiment having no intermediate element, the stack or each of the stacks may comprise an even number of drainage trench sub-units.

In order to protect the pillars of the bottommost drainage trench sub-unit from damage in this case too, it is proposed that the drainage trench sub-units should stand on a separate base area.

If the drainage trench sub-units are 16.5 cm tall, the base walls being 3.8 cm tall and lying on top of one another in the stacked state, and if the base plate is 4 cm tall, the stack will be approximately 131 cm tall if each of the stacks comprises thirty drainage trench sub-units, so that two stacks positioned on top of one another make optimum usage of the loading height of standard heavy goods vehicles.

If the transport unit comprises two stacks which are arranged next to each other and connected firmly to one another, one of the prongs of the lifting forks of a forklift truck can be inserted between two adjacent pillar rows of the bottommost drainage trench sub-units of both stacks in each case for loading and unloading the heavy goods vehicle.

Figure 3:
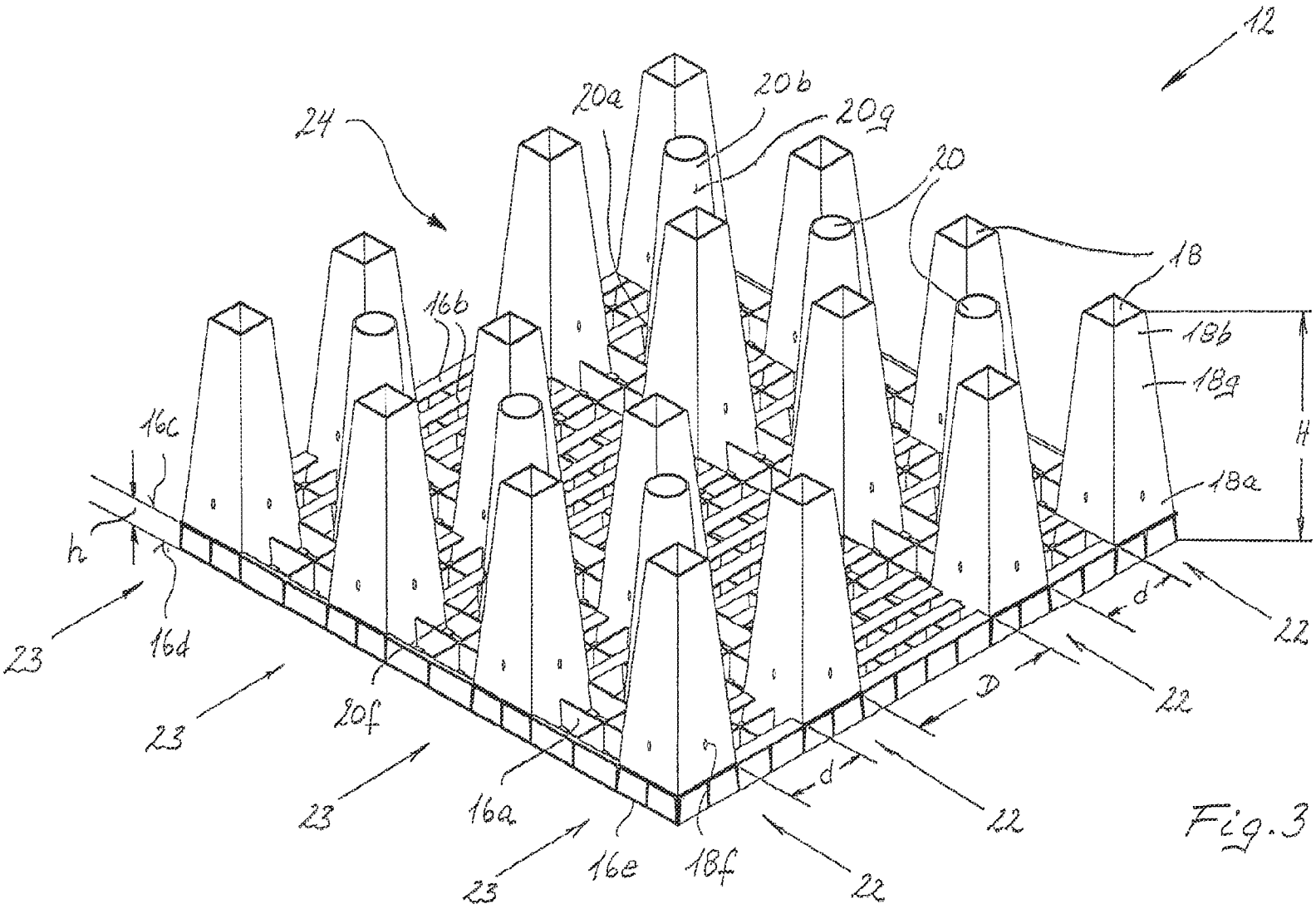
Figure 4:
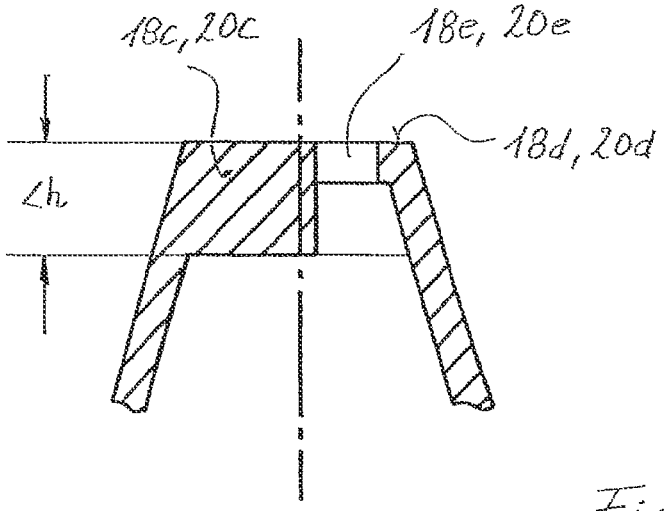
Figure 5:
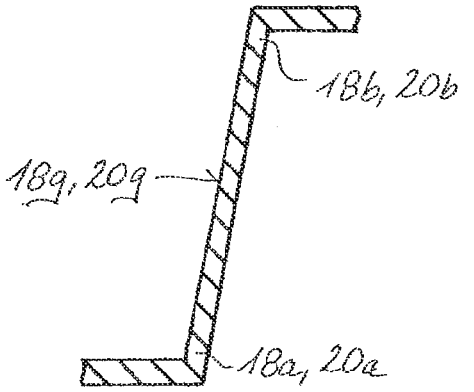
Figure 6:
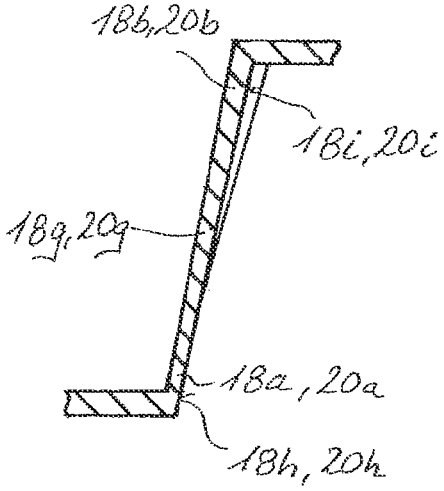
Figure 7:
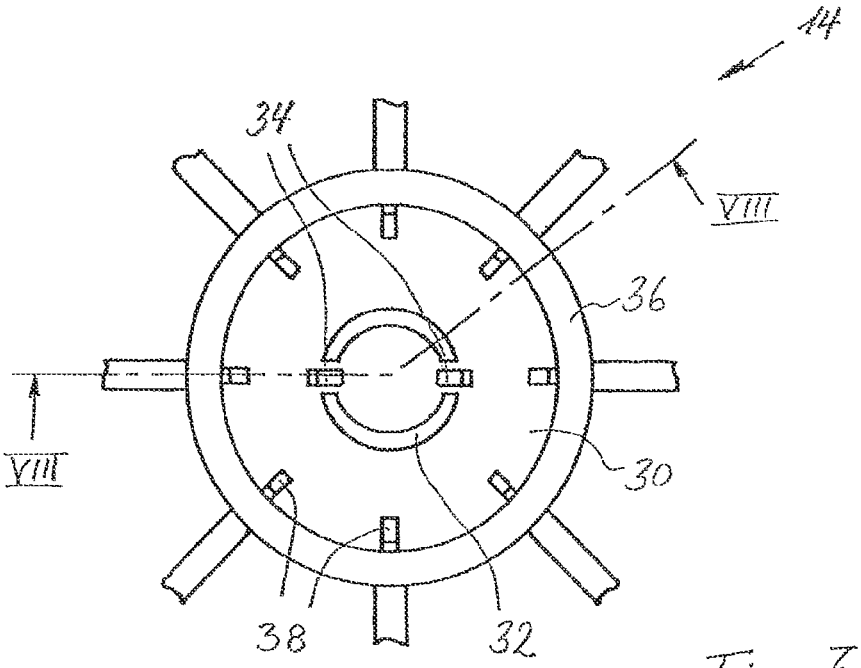
Figure 8:
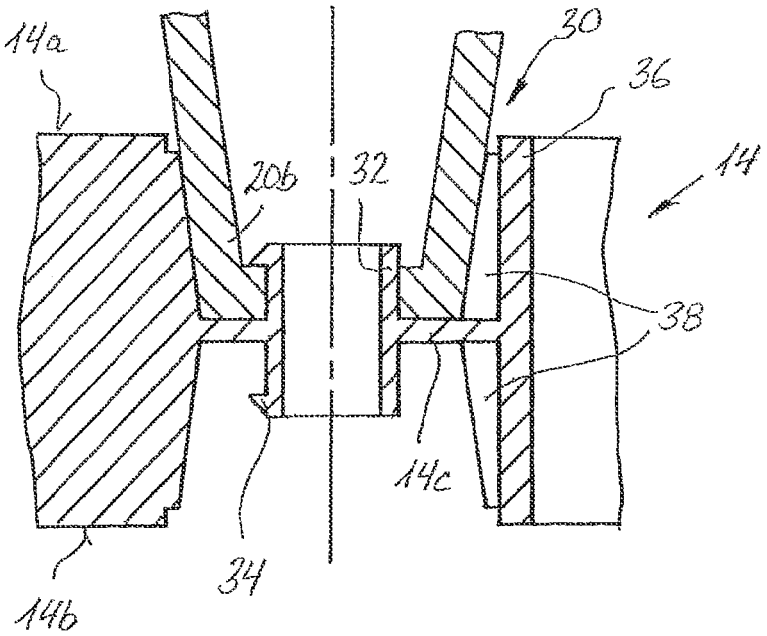
Figure 9:
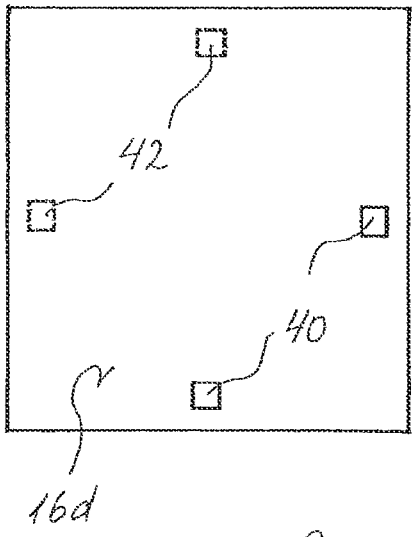
Figure 10:
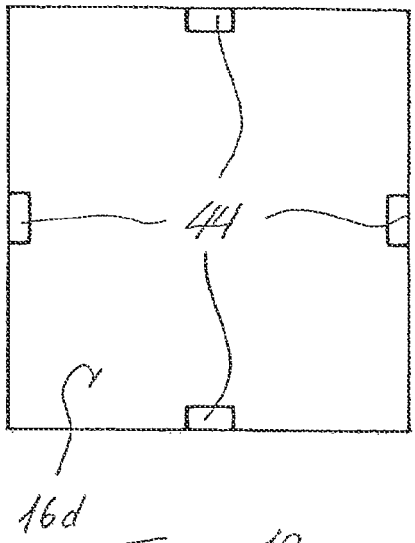
Figure 11:
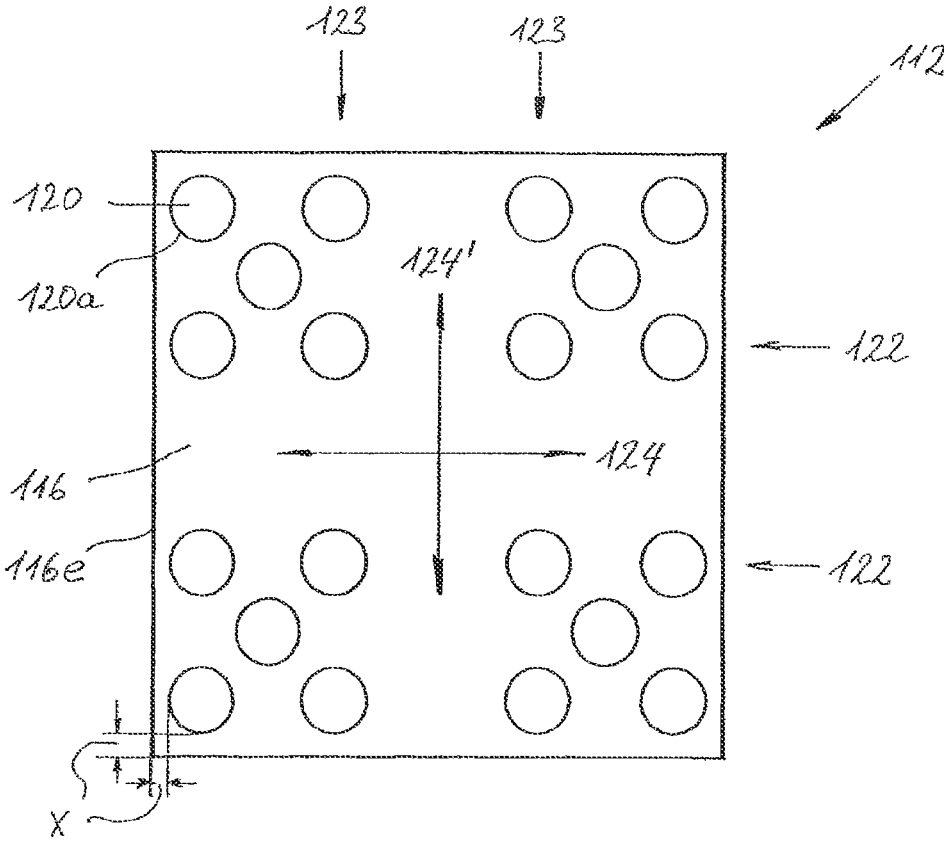
Figure 12:
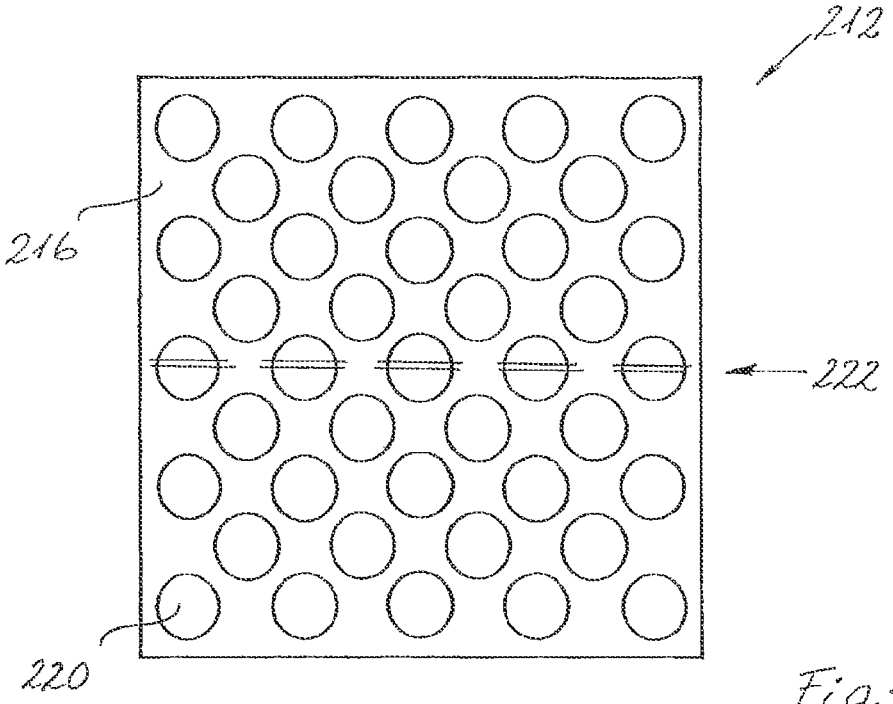
Figure 13:
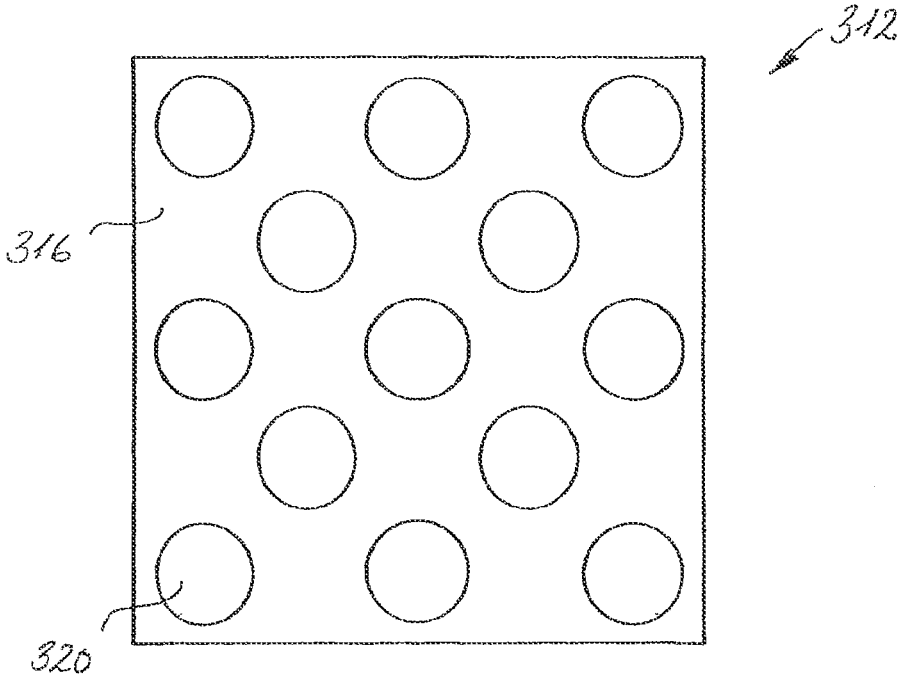
Figure 14A:
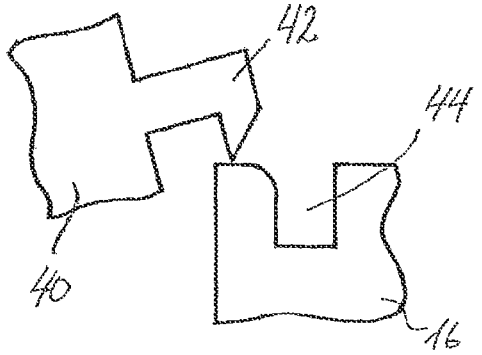
Figure 14B:
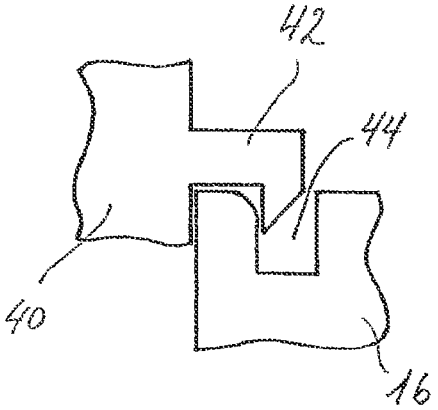
Figure 15:
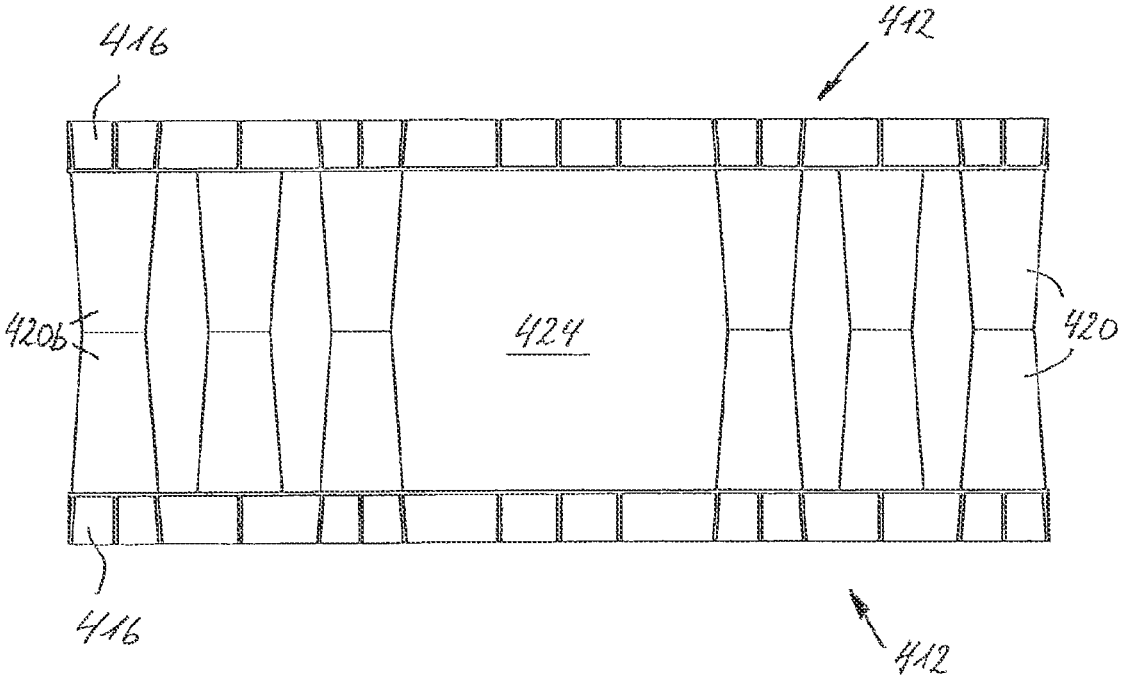
Figure 16:
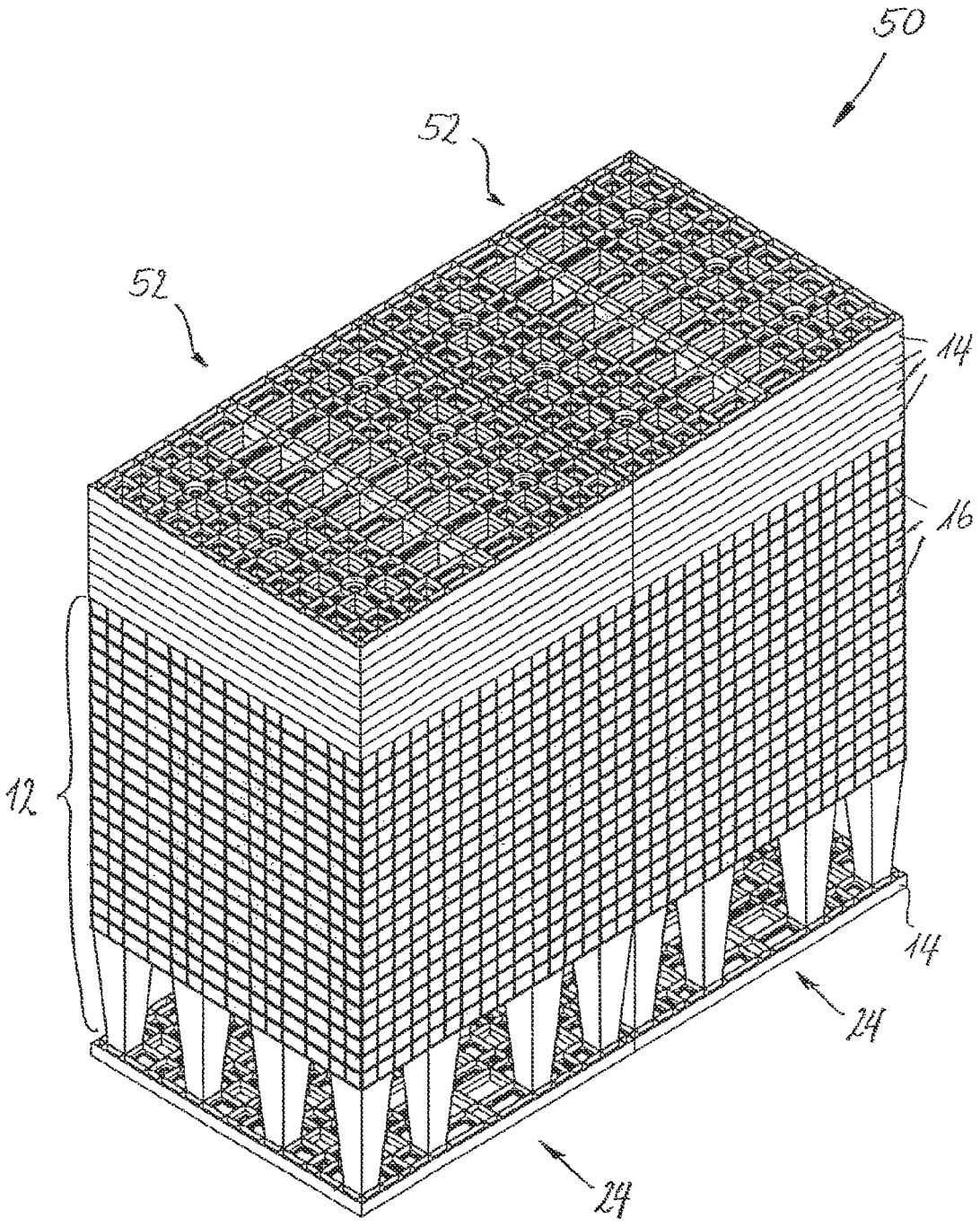
Figure 17:
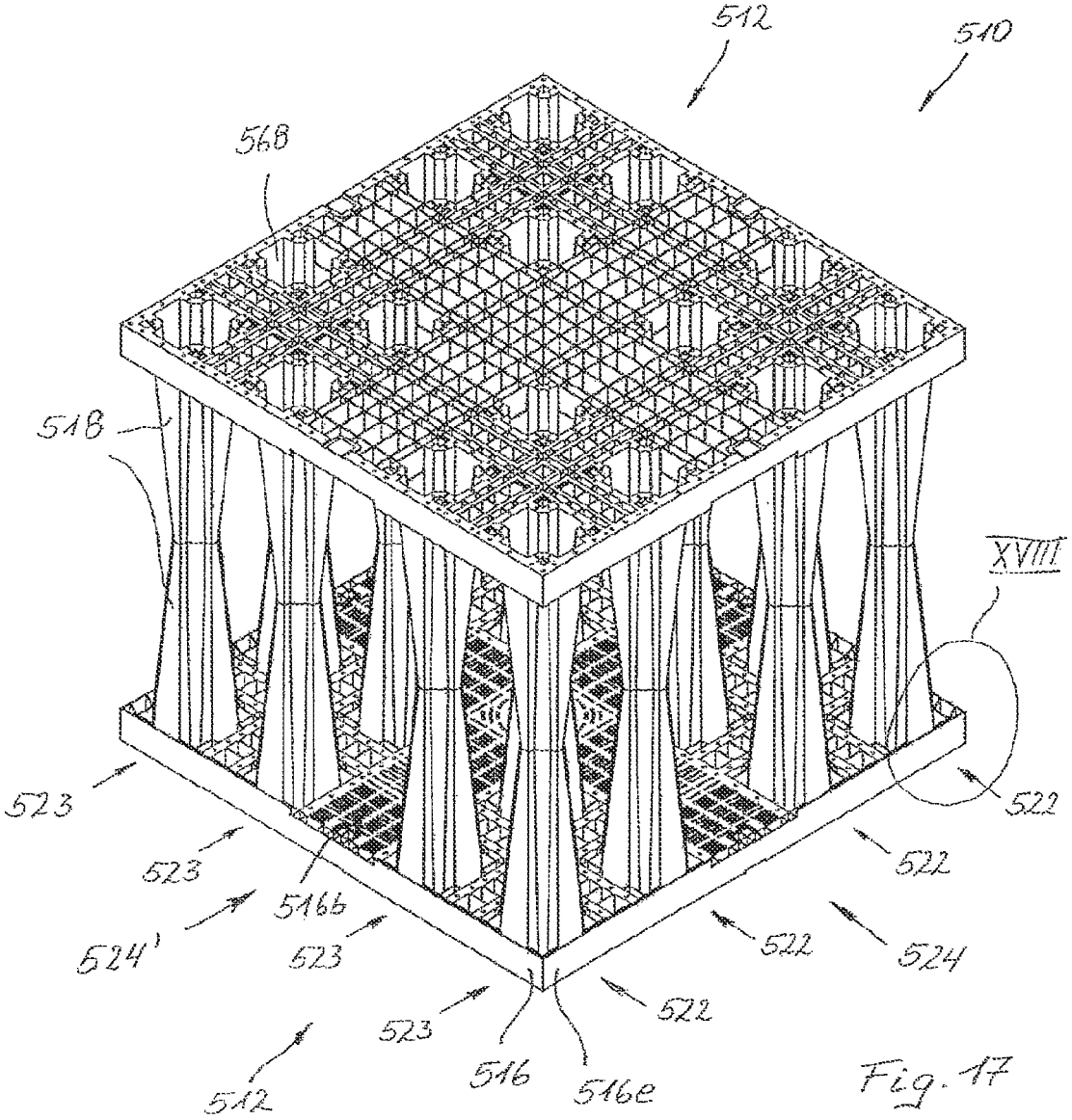
Figure 18:
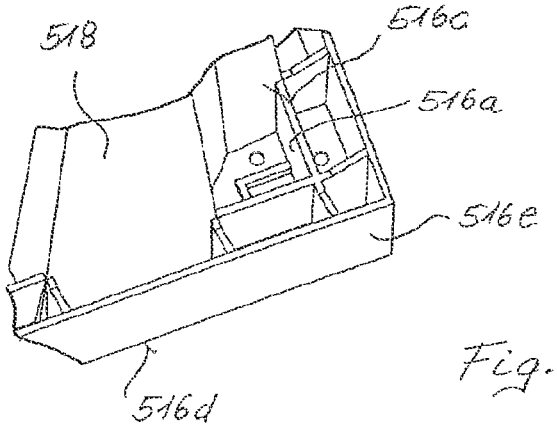
Figure 19:
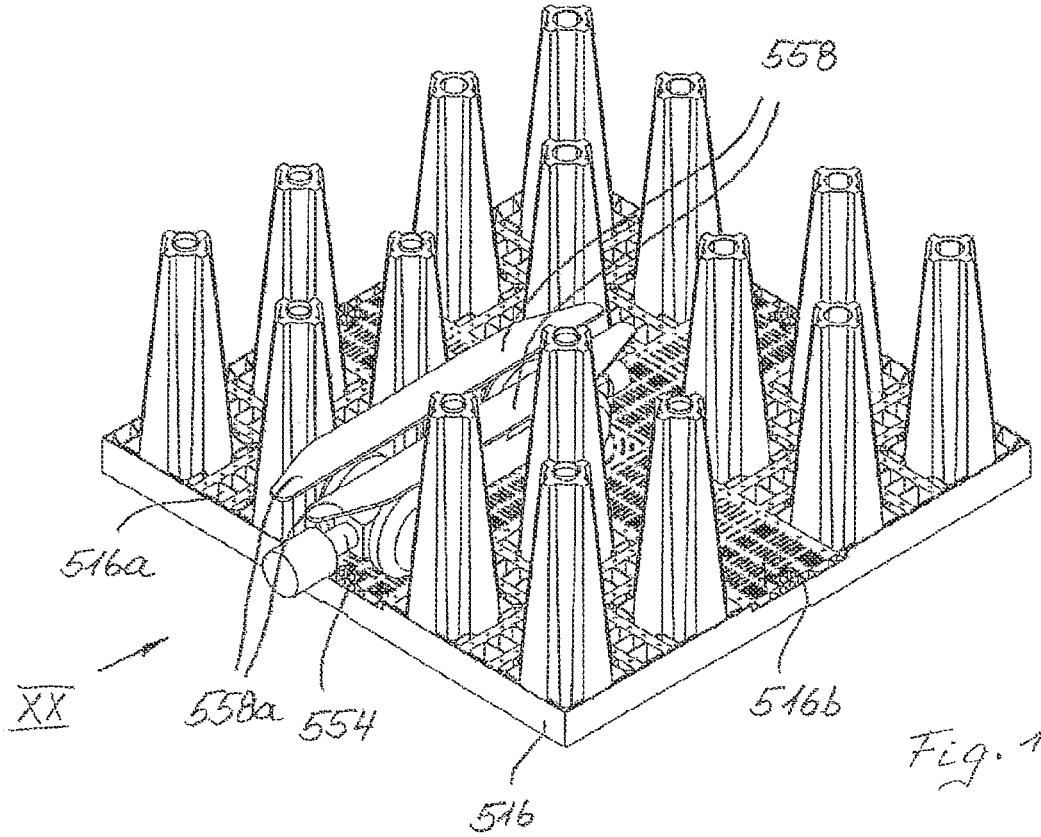
Figure 20:
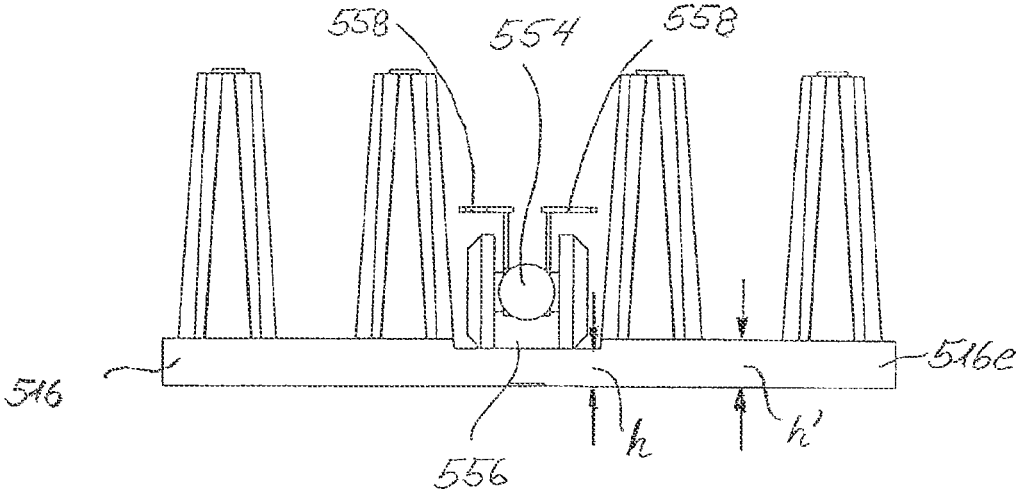
Figure 21:
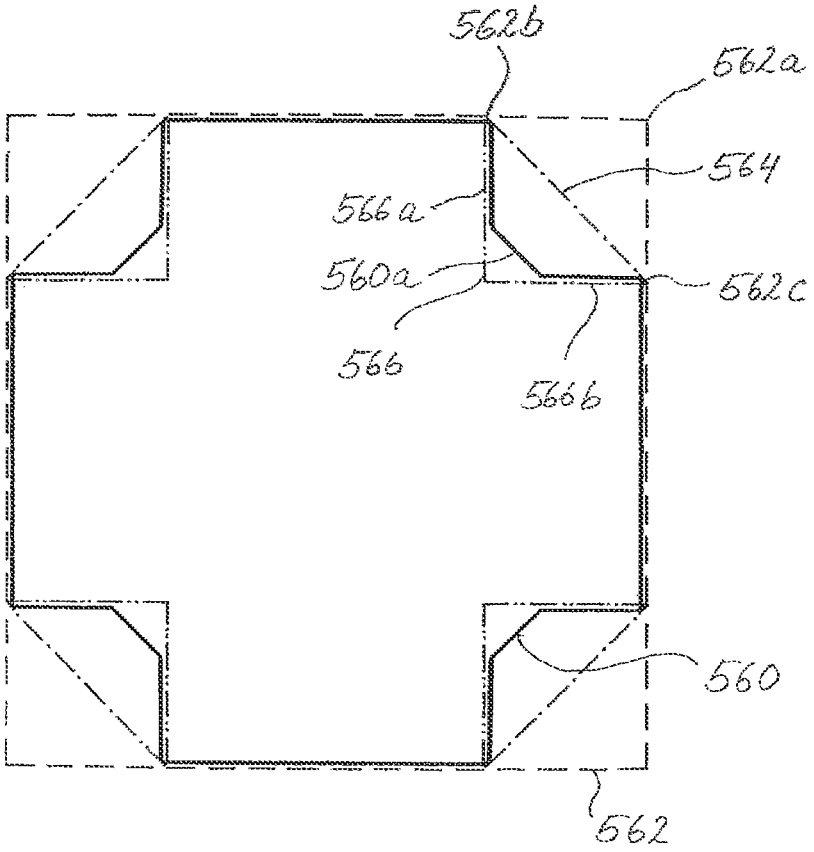

The invention is explained below in further detail with the aid of embodiments and using the attached drawings. These drawings are as follows:

FIG. 1 a perspective view of a drainage trench unit according to the invention;

FIG. 2 an end view of the drainage trench unit from FIG. 1 from the direction of arrow II in FIG. 1;

FIGS. 2*a* and 2*b* detailed views of alternative embodiments;

FIG. 3 a perspective view of a drainage trench sub-unit, as installed in the drainage trench unit according to FIG. 1;

FIG. 4 a detailed view of an alternative embodiment of a top end of a pillar;

FIGS. 5 and 6 schematic sectional views to explain alternative embodiments of the course of the peripheral wall of the pillars;

FIGS. 7 and 8 a top view (FIG. 7) and a sectional view (FIG. 8) to explain the structure of the latching recesses in an intermediate element of the drainage trench unit according to the invention to receive the top ends of the pillars;

FIGS. 9 and 10 schematic representations of the lower side of a drainage trench sub-unit to explain alternative embodiments to permit composite drainage trench units;

FIG. 11 to 13 schematic top views of alternative embodiments of drainage trench sub-units to explain various possibilities for arranging the pillars;

FIG. 14*a*, 14*b* schematic representations to explain how a side end element is fastened to the drainage trench unit;

FIG. 15 a view similar to FIG. 2 of a second embodiment of a drainage trench unit according to the invention;

FIG. 16 a perspective view of a transport unit for transporting the first embodiment of the drainage trench unit according to the invention;

FIG. 17 a view similar to FIG. 1 of a third embodiment of a drainage trench unit according to the invention, but without a side end element;

FIG. 18 an enlarged view of detail XVIII in FIG. 17 from another viewing direction as shown in FIG. 17;

FIG. 19 a view as per FIG. 17 of just the bottom drainage trench sub-unit with an inspection device moving along the inspection channel;

FIG. 20 a front view of the drainage trench unit according to FIG. 17 in the direction of arrow XX; and FIG. 21 a schematic representation to explain the cross-sectional form of the pillars of the third embodiment.

FIG. 1 shows a drainage trench unit, identified in general terms as 10. The drainage trench unit 10 comprises two drainage trench sub-units 12 of identical design which are connected to one another by means of an intermediate plate 14.

FIG. 2 is an end view of the drainage trench unit 10 from the direction of arrow II in FIG. 1, and FIG. 3 is a perspective view which gives a better idea of the structure of the drainage trench sub-units 12.

The drainage trench sub-unit 12 comprises a base wall 16 which is square in shape in the illustrated embodiment, a plurality of substantially hollow pillars 18 and 20 protruding from said base wall, said pillars tapering away from the base wall 16, i.e. from their base end 18*a*, 20*a* to their top end 18*b*, 20*b*. The pillars 18 have a square base outline in the illustrated embodiment and are arranged in a 4×4 grid with four pillar rows 22 and four pillar columns 23. The pillars 18 form a first group of pillars. The pillars 20 of the second group of pillars, on the other hand, have a substantially circular base outline and are arranged in two rows, each with three pillars, each of the pillars 20 being arranged in the middle of four pillars 18 from the first group of pillars.

No pillars 20 of the second group of pillars are provided between the pillars 18 of the two middle pillar rows 22. A free passage 24 is thus retained here, which may, for example, be used to insert an inspection device into the drainage trench unit 10. In order to create enough space for the inspection device, the spacing D between these two middle pillar rows 22 is larger than the spacing d between the other pairs of pillar rows 22.

The base wall 16 is designed with a lattice structure so that liquid can pass through it. In order to ensure that the lattice structure has a high level of stability, the lattice webs 16*a* are oriented such that their length and thickness dimensions run in the extension plane of the base wall 16, whilst their width dimension runs at right angles to this extension plane. In this case the thickness dimension is considerably smaller than the length and width dimensions of the lattice webs 16*a*.

Especially in the region of the passage 24 intended for insertion of the inspection device between the two middle pillar rows 22, surface elements 16*b* may also be provided in addition to the lattice webs 16*a*, said surface elements extending in the extension plane of the base wall 16, i.e. their length and width dimensions run in this extension plane, whilst the thickness dimension, which is considerably smaller, runs at right angles to said plane. These surface elements 16*b* form a support surface for the inspection device, for example a gangway for an inspection device running on wheels, for example a camera dolly.

It should also be added that the lattice webs 16*a*, which extend up to the base region 18*a* or 20*a* respectively of the pillars 18 and 20 and thus stabilise the pillars 18 and 20 to prevent tilting, run completely within the height h of the base wall 16, i.e. completely between its upper side 16*c* and its lower side 16*d*. In this manner, the drainage trench sub-units 12 can be stacked inside one another such that the spacing between the upper side 16*c* of a lower drainage trench sub-unit 12 and the lower side 16*d* of an upper drainage trench sub-unit 12 is smaller than the height h of the base wall 16 in the stacked state. In an ideal situation the drainage trench sub-units 12 can even be stacked with their base walls 16 lying against one another, as is shown in FIG. 16 by way of example.

With regard to the stackability of the drainage trench sub-units 12, the pillars 18 and 20 are substantially designed as hollow bodies. Reinforcing webs 18*c*, 20*c* may be provided in just one portion of the top ends 18*b* and 20*b* of the pillars 18 and 20, which do not extend as high as the height h of the base wall 16, as shown in a rough schematic diagram in FIG. 4 for both pillar types. These stabilising webs 18*c*, 20*c* may, for example, be provided in the form of a cross with two webs running at right angles to one another, as shown by the sectional view in FIG. 4, the left side of which shows a section through such a web, whilst the sectional plane on the right side encloses an angle of 45° with the sectional plane on the left side, for example. On the right-hand side we can also see that openings 18*e*, 20*e* remain on the end faces 18*d*, 20*d* of the top ends 18*b*, 20*b* of the pillars 18, 20 as a result of this cross web arrangement, said openings allowing liquid to pass into the inner space of the pillars 18, 20. The pillars 18, 20 are completely open at the base ends 18*a*, 20*a*, and thus designed to be permeable to liquid, as shown in FIG. 1, for example, in which the lower side 16*d* of the top drainage trench sub-unit 12 can be seen.

The pillars 18, 20 may also be equipped with openings 18*f*, 20*f*, on their peripheral surfaces to allow liquid to enter or leave the pillars 18, 20 in this case too.

As shown by comparing FIGS. 5 and 6, the peripheral walls 18*g*, 20*g* of the pillars 18, 20 extend between the base ends 18*a*, 20*a* and the top ends 18*b*, 20*b* with a substantially constant wall thickness (FIG. 5). Alternatively, however, it is also possible for the wall thickness to increase from the base end 18*a*, 20*a* to the top end 18*b*, 20*b*, as shown in FIG. 6. The minimum cross-sectional area of the pillar wall 18*g*, 20*g* in the area between the base end 18*a*, 20*a* and the top end 18*b*, 20*b* is crucial in terms of determining the vertical load-bearing capacity of the pillars 18, 20. As the pillars 18, 20 have a larger diameter or a larger peripheral length at their base end 18*a*, 20*a* than at their top end 18*b*, 20*b*, the wall thickness at the base end 18*a*, 20*a* may be designed to be less than at the top end 18*b*, 20*b*.

As already explained above, the passage 24 between the two middle pillar rows 22 is intended for insertion of the inspection device into the drainage trench unit 10. In order to be able to guarantee that the inspection device is guided in this inspection passage 24, as is shown in dashed lines in FIG. 2 by way of example, a tunnel element 26 may be provided which lies on the sides of the pillars 18 bordering the inspection passage 24 and is stabilised at the top by the intermediate plate 14. The tunnel element 26 may also be provided such that it engages in the openings 18*f* in the pillars 18 bordering the inspection passage 24, said openings facing the inspection passage 24, and is thus held securely in position, by means of protrusions (which are not illustrated).

The gangway 26*a* may also be formed on the tunnel element 26, as shown by dots and dashes in FIG. 2. By providing the tunnel element 26 the inspection passage 24 becomes an inspection channel.

The embodiment according to FIG. 2*a* is different from the above, merely in that the tunnel element 26' is arranged in a "U-shaped" configuration in the passage 24, i.e. a configuration in which the base web of the U-shape runs parallel to the base wall 16 of the drainage trench sub-unit 12. Otherwise, especially with regard to the way the tunnel element 26' is fastened to the drainage trench sub-unit 12, the embodiments in FIG. 2 should be referred to.

FIG. 2*b* shows an alternative embodiment which also allows the inspection passage 24 to become an inspection channel. As the inspection device is supported on the base wall 16, it merely requires a lateral guide in a height section adjacent to the base wall 16. For this reason, according to FIG. 2*b*, two boundary walls 27 are provided in the region of the base wall 16, said boundary walls being arranged on the base wall 16 such that they can swivel. The boundary walls 27 may, for example, be connected to the base wall 16 by means of an integral hinge. However, they may also be provided as separate components which are attached to the base wall 16 such that they can pivot. The boundary walls 27 may be swiveled between a first state, in which they run substantially parallel to the base wall 16 (see the left-hand boundary wall 27 in FIG. 2*b*) and a second state, in which they run substantially at right angles to the base wall 16 (see the right-hand boundary wall 27 in FIG. 2*b*). Furthermore, latching elements 27*a* may be provided on the boundary walls 27, said latching elements being able to engage in the lateral openings 18*f* in the pillars 18. Finally the boundary walls 27 may be equipped with a lattice structure, to which the comments made above in respect of the lattice structure of the base wall 16 apply in an identical manner.

Finally, according to a further embodiment, it is also possible not to attach the two boundary walls 27 to the drainage trench sub-unit 12 in a pivotable manner, but to connect them to the drainage trench sub-unit 12 by means of plug-in connecting elements.

As already mentioned above, the intermediate plate 14 serves to connect the two drainage trench sub-units 12 of the drainage trench unit 10 to one another (see FIG. 1). As is shown in FIGS. 7 and 8 in the case of a pillar 20 with a circular base outline, this connection may go beyond mere insertion inside one another, which would merely be able to hold the two drainage trench sub-units 12 and the intermediate plate 14 together in the horizontal direction, but not in the vertical direction. According to FIGS. 7 and 8, the top ends 20*b* of the pillars 20 are latched with the intermediate plate 14 so that vertical tensile forces can also be transmitted.

In order to receive the top ends 20*b* of the pillars 20 of the drainage trench sub-units 12 which are oriented inversely with respect to one another, the intermediate plate 14 comprises recesses 30 on both its upper side 14*a* and it lower side 14*b*, the top ends 20*b* of the pillars 20 being able to be inserted in said recesses. Substantially cylindrical protrusions 32 protrude into the recesses 30 from the common base area 14*c* of the two recesses 30, said recesses having two latching elements 34 in the illustrated embodiment, said latching elements being intended to interact with a preferably peripheral undercut on the top end 20*b* of the pillars 20.

It should be noted at this juncture that the embodiment shown in FIG. 4 with the stabilising web cross is not compatible with the latching mechanism according to FIGS. 7 and 8. However, if the protrusions 32 were omitted and the latching elements 34 were provided in isolation, the number of such latching elements possibly being increased, or doubled for example, if desired, the embodiment in FIG. 4 with the stabilising web cross could also be combined with an intermediate plate 14, which has latching recesses 30 as per FIGS. 7 and 8.

Furthermore, according to FIGS. 7 and 8, rib elements 38 are provided on the outer peripheral wall 36 of the recesses 30, said rib elements on the one hand serving as orientation inclines for the top end 20*b* of the pillars 20, and on the other hand lying on the peripheral wall 20*g* of the pillars 20 when the top ends 20*b* of the pillars 20 are completely inserted in the recesses 30 and thus absorbing and transferring horizontal forces to and from the latter. This thus results in a stable overall arrangement of the drainage trench unit 10 formed by the two drainage trench sub-units 12 and the intermediate plate 14.

The intermediate plate 14, which forms the intermediate element as defined in the claims, is designed with a lattice structure to allow liquid to pass through in the vertical direction. The comments made above in respect of the lattice structure of the base wall 16 apply in an identical manner to the formation of this lattice structure.

As drainage trenches, which are composed of drainage trench units 10 as per FIG. 1, can also be designed to be made up of more than one layer, i.e. with a plurality of drainage trench units 10 arranged on top of one another in the vertical direction, the lower side 16*d* of the base wall 16 of the drainage trench sub-units 12 may be designed with protrusions 40 and indentations 42, which are arranged at corresponding positions with respect to one another so that the protrusions 40 of a lower drainage trench unit 10 can engage in the indentations 42 of an upper drainage trench unit 10 and vice versa (see FIG. 9). This thus results in a composite structure which is stable with respect to displacements in the horizontal direction.

Alternatively, however, it is also possible to design the lower side 16*d* of the base wall 16 of the drainage trench sub-units 12 purely with recesses 44, as illustrated in FIG. 10 and to use separate (not illustrated) fastening elements to connect the drainage trench units 10 positioned on top of one another, said fastening elements engaging both in a recess 44 on the bottom drainage trench unit 10 and in a recess 44 in the upper drainage trench unit 10.

As can be seen particularly clearly in FIG. 2, the side end element 40 is supported laterally exclusively on the base walls 16 of the two drainage trench sub-units 12 and the intermediate plate 14, but not on the peripheral and corner pillars 18. In this way it is possible to prevent horizontal forces which are applied to the drainage trench unit 10 from the soil surrounding the drainage trench via the side end element 40 being applied to the drainage trench unit 10 via the pillars 18. This can be improved still further by a lateral projection x in the base walls 16 (see FIG. 11) beyond the base end 18*a* of the pillars 18, as is explained below in greater detail for the embodiments in FIG. 11 to 13.

In addition, FIG. 2 shows that the intermediate plate 14 extends in the horizontal direction beyond the top ends 18*b* of the pillars 18 and even preferably up to the side end element 40. In this manner, the side end element 40 has the same dimensions in terms of its length and width as the base walls 16 and provides a further lateral support for the side end element 40 between the two base walls 16. Furthermore, if the drainage trench units 10 lie on top of another, not only do the base walls 16 of adjacent drainage trench units 10 lie on top of one another, but also their intermediate plates 14. Thus, the intermediate plates 14 can also be used to transmit horizontal forces from drainage trench unit 10 to drainage trench unit 10.

The structural measures described above make it possible to separate the transmission of horizontal forces and the transmission of vertical forces within the drainage trench formed by a plurality of drainage trench units 10 according to the invention. Whilst vertical forces are transmitted by the pillars 18, 20, horizontal forces are transmitted by the base walls 16 and the intermediate plates 14. Overloading of the pillars 18, 20 by the simultaneous action of horizontal and vertical forces can be avoided in this manner. This has an advantageous effect on the stability of the drainage trench.

FIGS. 11, 12 and 13 show schematic representations of further embodiments of drainage trench sub-units 112, 212, 312 viewed from above, merely indicating the outline of the base walls 116, 216, 316 and the position of the pillars 120, 220, 320 in rough schematic form.

As in the case of the drainage trench sub-unit 12 in FIG. 3, the pillars of the drainage trench sub-unit 112 according to FIG. 11 are arranged in a 4×4 grid, although an inspection passage 124 is not only provided between the two middle pillar rows 122, but an inspection passage 124' is also provided between the two middle pillar columns 123.

In the case of the embodiment according to FIG. 11, it should also be noted that the base ends 120*a* of the pillars 120 have a pre-defined spacing x from the peripheral edge 116*e* of the base wall 116. The lattice webs of the base wall 116, which are responsible for the tilting stability of the pillars 120, may thus be arranged such that they are distributed over the entire periphery of the pillars 120, even in the case of peripheral or corner pillars 120, and this increases the tilting stability of the peripheral or corner pillars 120. This feature, i.e. this edge spacing x, can of course also be provided in the embodiment according to FIG. 3.

The drainage trench sub-unit 212 according to FIG. 12 has a first group of pillars which are arranged in a 5×5 grid, pillars from a second group of pillars which are arranged in a 4×4 grid being provided between the pillars of the first group of pillars. An inspection passage may also be provided in this embodiment as a general rule, for example by omitting one of the pillar rows and/or pillar columns, as is indicated in FIG. 12 by a line of double dashes for the middle pillar row 222.

The drainage trench sub-unit 312 according to FIG. 13 has a first group of pillars, which are arranged in a 3×3 grid, and a second group of pillars which are arranged in a 2×2 grid.

The embodiment options for the embodiment shown in FIG. 1 or 3 may be referred to for further embodiment options for the embodiments shown in FIGS. 11, 12 and 13, as explained above with reference to FIGS. 2, 2*a* and 4 to 10. All of these possible further developments may also be achieved in an identical manner in the embodiments shown in FIGS. 11, 12 and 13.

As shown in FIG. 1, side end elements 40 may be attached to the side of the drainage trench units 10, for example side end plates with a lattice structure. These side end elements 40 are preferably attached to the peripheral drainage trench units 10 of a drainage trench composed of a plurality of such drainage trench units 10 in order to seal off the inner volume of the drainage trench. In particular, the side end elements 40 serve as supporting bodies for a geotextile with which such drainage trenches are usually covered in order to prevent soil penetrating the inner space of the drainage trench in the operating state, in which the drainage trench is located in the soil. In this case, the comments made in respect of the lattice structure of the base walls 16 apply in identical terms to the lattice structure of the side end elements 40.

Latching elements 42 may be provided on the side end elements 40, said latching elements serving to fasten the side end elements 40 to the base walls 16 of the drainage trench sub-unit 12 and, if desired, also to the intermediate plate 14. These latching elements 42 may, for example, engage in appropriate latching recesses 44 in the base wall 16. In order to facilitate assembly, these latching connections 42/44, as shown schematically in FIG. 14*a*, 14*b*, may be designed as pivot bearings. This allows the assembly staff to first position the side end plate 40 in a tilted position with respect to the drainage trench unit 10 with the latching element 42 on the base wall 16 of the lower drainage trench sub-unit 12 and then to pivot the side end plate 40 onto the drainage trench unit 10 until the upper latching element 42 engages in the latching recess 44 of the base wall 16 of the upper drainage trench sub-unit. During the course of this movement, the lower latching element 42 is easily inserted in the latching recess 44 of the base wall 16 of the lower drainage trench unit 12.

To enable the drainage trench units 10 to be combined with the traditional drainage trench units marketed by the applicant under the name "Rigofill inspect" without any problems, it is preferable for the base wall 16 to be designed as a square, the edge length of the square being approximately 80 cm and the height H of the drainage trench unit 10 being approximately 66 cm so that the height of a drainage trench sub-unit 12 is approximately 33 cm. As a general rule, however, it is also conceivable to design the drainage trench sub-units so that they are just 16.5 cm tall, with the result that a total of four drainage trench sub-units are required to form an assembly which is compatible in terms of height with a traditional drainage trench unit. FIG. 15 shows a sub-assembly formed from two such drainage trench sub-units 12 with lower pillars 420. As the pillars 420 are shorter in this embodiment, their top ends 420*b* can be connected directly without leading to any problems with lateral stability, i.e. in particular without arranging an intermediate plate similar to the intermediate plate 14 according to the embodiment in FIGS. 1 and 3 in between them.

An inspection passage 424 may also be provided in the embodiment in FIG. 15. Furthermore, the above comments with reference to the embodiment according to FIGS. 1 and 3 apply in an identical manner with regard to the further development possibilities for the base wall 416 and the pillars 420 and the possibility of providing at least one inspection channel.

FIG. 16 shows a transport unit 50 for a total of twenty drainage trench units 10 for the embodiment according to FIGS. 1 and 3. It comprises two stacks 52, each of these stacks comprising twenty drainage trench sub-units 12 nested inside one another, said drainage trench sub-units having their pillars protruding downwards. An intermediate plate 14 forms the base area of each stack 52 and a further nine intermediate plates 14 form the upper end of each stack 52. The elements of each stack 52 can be held together in a manner known per se with plastic strapping. Similarly the two stacks 52 can also be connected to the transport unit 50 with plastic strapping. In the configuration illustrated in FIG. 16, the inspection passages 24 of the bottommost drainage trench sub-unit 12 in both stacks 52 in each case can be used to insert a respective prong of the lifting gear of a forklift truck so that the transport unit 50 can be set down in a simple manner on the loading area of a heavy goods vehicle or lifted off said loading area again.

FIG. 17 to 21 show a third embodiment of a drainage trench unit according to the invention which substantially corresponds to the embodiment according to FIG. 1. Identical parts in FIG. 17 to 21 are therefore assigned the same reference numerals as FIG. 1, but with an additional 500 in front of the number. In addition, the drainage trench unit 510 shown in FIG. 17 to 21 is only described below to the extent that it differs from the description of the drainage trench unit 10 shown in FIG. 1, which is otherwise expressly referred to.

A first difference between the drainage trench unit 510 and the drainage trench sub-units 512, of which they are composed, and the drainage trench unit 10 and its drainage trench sub-units 12 is that its pillars 518 are only arranged in a 4×4 grid. However the pillars 518 of both the second and third pillar rows 522 and the second and third pillar columns 523 have a larger spacing between each other than the first pillar row and the second pillar row, the third pillar row and the fourth pillar row, the first pillar column and the second pillar column and the third pillar column and the fourth pillar column (also see FIG. 11). In this manner an inspection passage 524 is not only formed between the two middle pillar rows 522, but an inspection passage 524' is also provided between the two middle pillar columns 523. In the region of these inspection channels 524, 524', the lattice structure 516*a* of the base wall 516 of the drainage trench sub-units 512 is covered by a support surface 516*b* for an inspection device 554 (see FIGS. 19 and 20), for example a gangway for an inspection device running on wheels, for example a camera dolly.

A second difference is that the base wall 516 of the drainage trench sub-unit 512 has a higher peripheral edge 516*e*. In other words, the height h' of the peripheral wall 516*e* (see FIG. 20) on the majority of the periphery of the base wall 516 is taller than the height h of the remaining base wall, i.e. than the spacing between its upper side 516*c* and its lower side 516*d*. The peripheral edge 516*e* is the same height as the remaining base wall 516 only in the region of the access points 556 to the support surfaces 516*b* of the inspection channels 524, 524' (see FIG. 20 in particular). The reason for the increased height of the peripheral edge is as follows:

It has transpired that the packing density achieved by stacking the drainage trench sub-units 512 is so high that the load-bearing capacity of the heavy goods vehicles usually used to transport the units to the construction site is reached before the available loading volume of the heavy goods vehicles is fully utilised. The present embodiment utilises the remaining loading volume to build the peripheral edge 516*e* of the base wall 516 even higher. By increasing the peripheral edge 516*e*, this only entails a slight increase in the materials used. On the other hand, this can increase the reliability with which horizontal forces are transmitted from drainage trench unit to drainage trench unit when the drainage trench units are in the assembled state, and the lower access areas 556 can also be used as recessed grips for gripping and separating the drainage trench sub-units 512 from the transport stack (see FIG. 16).

It should also be noted that the lattice webs 516*a*, which are adjacent to the peripheral edge 516, fall obliquely away from the peripheral edge 516*e* towards the remaining base wall 516, as is shown in FIG. 18 in particular. In respect of FIG. 17 it should be noted in this connection that the fact that the pillars 518 do not seem to be spaced away from the peripheral edge 516 on the two front edges of the base wall 516, as confirmed by FIG. 18, is merely due to a perspective distortion.

A third difference is down to the fact that the pillars 518 have neither a square nor a circular cross-section, but a cruciform cross-section. In particular, the outline 560 (shown with an unbroken line in FIG. 21) of the cruciform cross-section has the following properties:

It runs partly along the outline of an imaginary square 562 (shown as a dashed line in FIG. 21), the side edges of said square running in parallel with the side edges of the base wall 516, and partly inside the outline of this square 562, but not outside the outline of this square 562. One portion 560*a* of the outline 560 of the cruciform cross-section, which is assigned to at least one corner 562*a*, preferably all corners, of this square 562, runs between a first outline point 562*b* of the square 562 and a second outline point 562*c* of the square 562 inside the outline of the square 562. In this case this portion 560*a* of the outline 560 of the cruciform cross-section runs inside a connecting straight line 564 (shown as a dash-dot line in FIG. 21) between the first and second outline points 562*b*, 562*c* of the square 562 and outside or if necessary along a connecting line 566 (shown as a dash-dot-dot line in FIG. 21) which has two rectilinear portions 566*a* and 566*b*, each of said rectilinear portions departing from either the first or second outline points 562*b*, 562*c* of the square 562 and running at right angles to the side edge on which the respective outline point is located. Furthermore, the length of this portion 560*a* of the outline 560 of the cruciform cross-section is preferably shorter than the connecting line 566.

In respect of FIG. 21 it should be noted that where the unbroken line of the outline 560 runs directly adjacent to one of the auxiliary lines 562 and 566, the outline 560 runs along this auxiliary line and the slight separation between the two lines in the drawing is merely intended to increase the clarity of the drawing.

It should be stressed at this point that the above-mentioned properties should merely be regarded as one method of circumscribing the concrete shape of the cruciform cross-section of the pillars 518, but not, however, as instructions for the actual manufacture of the pillars 518.

The "indentations" which appear in the outline 560 in the corners 562*a* of the imaginary square 562 have the advantage that they reduce the free lengths of the openings 568 (see FIG. 17) to be bridged, said openings leading into the lower side 516*d*, pointing away from the pillars 518, of the base wall 516 of the drainage trench sub-unit 512 arranged with pillars 518 pointing downwards, without increasing the amount of material used in comparison with pillars with a square cross-section (square 562). In this manner it is possible for the assembly staff to walk on the lower side 516*d* of the base wall 516 of the drainage trench sub-unit 512 arranged with pillars 518 pointing downwards, for example on the construction site, without having to cover the openings 568 with special cover elements in order to guarantee the safety of assembly staff.

As is evident in FIGS. 19 and 20, it is advantageous to attach guide elements 558 to the inspection device 554, said guide elements making it possible to guide the inspection device 554 laterally on the pillars 518 bordering the inspection channel 524 or 524'. These guide elements 558, which are equipped with orientation inclines 558*a*, ensure that the inspection device 554 does not go astray between the pillars 518, but is held reliably in the inspection channel 524 or 524'. The use of such guide elements 558 is known per se from the inspection of pipes with an oval cross-section, but fulfils a quite different role in that case, namely in that it guarantees that the inspection device tilts despite contact with the steep walls of the oval pipes, a problem which does not arise in the drainage trench units according to the invention due to the substantially planar support surface in the inspection channel.

To summarise, the invention relates to the following subjects:

Subject 1:

Drainage trench unit (10) which comprises at least one drainage trench sub-unit (12), the at least one drainage trench sub-unit (12) having a base wall (16) and a plurality of hollow pillars (18, 20), said pillars (18, 20) being connected integrally to the base wall (16) and tapering, preferably conically, away from the base wall (16), i.e. tapering from their base end (18*a*, 20*a*) to their top end (18*b*, 20*b*).

Subject 2:

Drainage trench unit according to subject 1,
in which the pillars (18, 20) are designed and/or the wall thickness and or degree of tapering or the conical angle of the pillars (18, 20) is/are dimensioned such that, when two drainage trench sub-units (12) with the same orientation and identical forms are stacked inside one another, the spacing between the base walls (16) of the two drainage trench sub-units (12) is less than the thickness (h) of the base wall (16), preferably less than half the thickness (h) of the base wall (16), it being even more preferable if the base walls (16) of the two drainage trench sub-units (12) lie against one another (FIG. 16).

Subject 3:

Drainage trench unit according to subject 1 or 2,
in which the spaces between adjacent pillars (18, 20) are free of these connecting elements, and are especially free of connecting walls.

Subject 4:

Drainage trench unit according to any of subjects 1 to 3 in which lateral reinforcing ribs (16*a*), which support at least one pillar (18, 20), preferably a plurality of pillars, or even more preferably all pillars, at their base end (18*a*, 20*a*) and prevent them from tilting, extend merely within the height (h) of the base wall (16).

Subject 5:

Drainage trench unit according to any of subjects 1 to 4, in which peripheral and corner pillars (120) have a predefined spacing (x) from the edge (116*a*) of the base wall (116), this spacing (x) being between approximately 1 cm and approximately 5 cm for example.

Subject 6:

Drainage trench unit according to any of subjects 1 to 5, in which the inner space of the plurality of pillars (18, 20) if necessary comprises reinforcing elements (18*c*, 20*c*), for example reinforcing struts, at a level adjacent to the top end, the height of said level corresponding to the thickness (h) of the base wall (16).

Subject 7:

Drainage trench unit according to any of subjects 1 to 6, in which the pillars (18, 20) have a substantially constant wall thickness (FIG. 5) over their entire height.

Subject 8:

Drainage trench unit according to any of subjects 1 to 6, in which the wall thickness of the pillars (18, 20) varies from their base end (18*a*, 20*a*) to their top end (18*b*, 20*b*), preferably decreasing from their top end (18*b*, 20*b*) to their base end (18*a*, 20*a*).

Subject 9:

Drainage trench unit according to any of subjects 1 to 8, in which at least one reinforcing rib (18*i*, 20*i*) is provided on the outer peripheral surface and/or the inner peripheral surface (18*h*, 20*h*) of at least one pillar (18, 20), the radial height of the at least one reinforcing rib (18*i*, 20*i*) varying for example from the base end (18*a*, 20*a*) to the top end (18*b*, 20*b*) of the pillar (18, 20), preferably increasing.

Subject 10:

Drainage trench unit according to any of subjects 1 to 9, in which the peripheral wall of at least one pillar (18), preferably all pillars, comprises at least one opening (18*f*) which allows liquid to pass through.

Subject 11:

Drainage trench unit according to subject 9,
in which the at least one opening (18*f*) is arranged nearer to the base end (18*a*) of the pillar (18) than to its top end (18*b*), or is preferably arranged adjacent to its base end.

Subject 12:

Drainage trench unit according to any of subjects 1 to 11, in which the end face (18*d*, 20*d*) of the top end (18*b*, 20*b*) and/or the base end (18*a*, 20*a*) of at least one pillar (18, 20), preferably each pillar, said end face running at right angles to the vertical direction of the pillar, comprises at least one opening (16*e*, 20*e*) which allows liquid to pass through.

Subject 13:

Drainage trench unit according to any of subjects 1 to 12, in which the base wall (16) is designed as a lattice structure, at least in part, preferably substantially completely.

Subject 14:

Drainage trench unit according to any of subjects 1 to 13, in which the base wall (16) comprises a base area which is substantially square.

Subject 15:

Drainage trench unit according to any of subjects 1 to 14, in which the edge length of the base wall (16) in the longitudinal direction and/or in the width direction is less than 90 cm, preferably 80 cm±1 cm.

Subject 16:

Drainage trench unit according to any of subjects 1 to 15, in which the height (H) of the drainage trench sub-unit (12) is substantially 33 cm or substantially 22 cm or substantially 16.5 cm.

Subject 17:

Drainage trench unit according to any of subjects 1 to 16, in which the pillars (18) or the pillars of a first group of pillars are arranged in a 4×4 grid, i.e. in a grid with four pillar rows (22) and four pillar columns (23), each pillar (18) being assigned to a pillar row (22) and a pillar column (23).

Subject 18:

Drainage trench unit according to subject 17,
in which the spacing (D) between at least one pair of adjacent pillar rows (22) and/or pillar columns is larger than the spacings (d) between other adjacent pillar rows (22) or pillar columns.

Subject 19:

Drainage trench unit according to subject 17 or 18,
in which a second group of pillars is provided, each pillar (20) in the said second group of pillars being arranged between four pillars (18) which are adjacent to each other in the first groups of pillars.

Subject 20:

Drainage trench unit according to any of subjects 1 to 16, in which the pillars (320) or the pillars of a first group of pillars are arranged in a 3×3 grid, i.e. in a grid with three pillar rows, each comprising three pillars (320) (FIG. 13).

Subject 21:

Drainage trench unit according to subject 20,
in which the pillars (320) of a second group of pillars are arranged in two rows, each with two pillars, each pillar in the second group of pillars being arranged between four pillars which are adjacent to each other in the first groups of pillars, and none of the pillars in the first group of pillars being adjacent to two pillars from the second group of pillars which belong to different pillar rows (FIG. 13).

Subject 22:

Drainage trench unit according to any of subjects 1 to 16, in which the pillars (220) or the pillars of a first group of pillars are arranged in a 5×5 grid, i.e. in a grid with five pillar rows, each comprising five pillars (FIG. 12).

Subject 23:

Drainage trench unit according to subject 22,
in which the pillars (220) of a second group of pillars are arranged in four rows, each with four pillars, each pillar in the second group of pillars being arranged between four pillars which are adjacent to each other in the first groups of pillars, and none of the pillars in the first group of pillars being adjacent to two pillars from the second group of pillars which belong to different pillar rows (FIG. 12).

Subject 24:

Drainage trench unit according to any of subjects 19, 21 and 23,
in which at least one pillar row (222) and/or pillar column from the first group of pillars and/or the second group of pillars is not equipped with pillars (FIG. 12).

Subject 25:

Drainage trench unit according to any of subjects 1 to 24, in which a surface portion of the base wall (16) arranged between two adjacent pillar rows (22), said portion extending from a side edge of the base wall (16) to its opposite side edge, is designed as a support surface, i.e. a maximum of 50%, preferably a maximum of 25%, of its surface is breached by openings, preferably longitudinal slots, said slots running in a longitudinal direction which is preferably at right angles to the connection direction of the two side edges.

Subject 26:

Drainage trench unit according to subject 25, in which the width of the surface portion is at least 50%, preferably at least 75% or even more preferably substantially 100% of the spacing between the base ends (18*b*) of the adjacent pillar rows (22) at the height of the base wall (16).

Subject 27:

Drainage trench unit according to any of subjects 1 to 26, in which at least one pillar (18), preferably at least one peripheral pillar, comprises at least one planar peripheral wall surface portion.

Subject 28:

Drainage trench unit according to any of subjects 1 to 27, in which at least some of the pillars (20), preferably all pillars, have a substantially circular base area.

Subject 29:

Drainage trench unit according to any of subjects 1 to 28, in which the surface (16*d*) of the base wall (16) facing away from the pillars (18, 20) is designed such that two drainage trench sub-units (12) with an identical design and oriented inversely with respect to each other in the vertical direction can be connected to each other so that they do not move in the horizontal direction (FIG. 9, 10).

Subject 30:

Drainage trench unit according to any of subjects 1 to 29, in which the surface (16*d*) of the base wall (16) facing away from the pillars (18, 20) is designed with at least one protrusion (40) and at least one recess (42) such that two drainage trench sub-units (12) with an identical design and oriented inversely with respect to each other in the vertical direction can be arranged such that they interlock positively in the horizontal direction.

Subject 31:

Drainage trench unit according to any of subjects 1 to 30, in which the surface (16*d*) of the base wall (16) facing away from the pillars (18, 20) is designed such that two drainage trench sub-units (12) with an identical design and oriented inversely with respect to each other in the vertical direction can be connected to each other positively in the horizontal direction by means of at least one connecting element (FIG. 10).

Subject 32:

Drainage trench unit according to any of subjects 1 to 31, said drainage trench unit comprising two drainage trench sub-units (12) which are arranged with the top ends (18*b*, 20*b*) of their pillars (18, 20) pointing towards one another, and preferably connected together at the corresponding top ends (18*b*, 20*b*) of pillars (18, 20) belonging to different drainage trench sub-units (12).

Subject 33:

Drainage trench unit according to subject 32, in which a preferably plate-shaped intermediate element (14) is arranged between the two drainage trench sub-units (12), said intermediate element (14) connecting the top ends (18*b*, 20*b*) of the pillars (18, 20) of both drainage trench sub-units (12) together.

Subject 34:

Drainage trench unit according to subject 33, in which the intermediate element (14) has at least in part substantially the same dimensions as the base wall (16) of the drainage trench sub-units (12) in at least one of its main extension directions, i.e. in its longitudinal extension and/or in its width extension.

Subject 35:

Drainage trench unit according to subject 33 or 34, in which the intermediate element (14) is substantially the same length and/or width as the base wall (16) of the drainage trench sub-units (12).

Subject 36:

Drainage trench unit according to any of subjects 1 to 31, in which the drainage trench unit (10) is formed by a single drainage trench sub-unit (12) and an intermediate element (14) with the intermediate element features according to any of subjects 33 to 35.

Subject 37:

Drainage trench unit according to any of subjects 33 to 36, in which a surface portion arranged between two adjacent pillar rows (22), said portion extending from an edge of the intermediate element (14) to its opposite edge, is designed as a support surface, i.e. a maximum of 50%, preferably a maximum of 25%, of its surface is breached by openings, preferably longitudinal slots, said slots running in a longitudinal direction which is preferably at right angles to the connection direction of the two edges.

Subject 38:

Drainage trench unit according to subject 37, in which the width of the surface portion is at least 50%, preferably at least 75% or even more preferably substantially 100% of the spacing between the base ends (18*a*) of the adjacent pillar rows (22) at the height of the intermediate element (14).

Subject 39:

Drainage trench unit according to any of subjects 33 to 38, in which the intermediate element (14) is at least partially designed as a lattice structure.

Subject 40:

Drainage trench unit according to any of subjects 33 to 39, in which the intermediate element (14) may comprise recesses (30) both in its upper surface and in its lower surface for receiving the top ends (20*b*) of the pillars (20) of the two drainage trench sub-units (12).

Subject 41:

Drainage trench unit according to subject 40, in which the top ends (20*b*) of the pillars (20) engage over a maximum depth of 2 cm, preferably a maximum depth of 1.5 cm, in the associated recesses (30).

Subject 42:

Drainage trench unit according to subject 40 or 41, in which the top end (20*b*) of at least one pillar (20), preferably a plurality of pillars, or even more preferably all pillars, can be latched in the associated recess (30).

Subject 43:

Drainage trench unit according to subject 42, in which the top end (20*b*) of at least one pillar (20) comprises a collar protruding radially inwards, with which a latching element (34) protruding from the base of the recess (30) can be latched.

Subject 44:

Drainage trench unit according to any of subjects 40 to 43, in which the recesses (30) are cylindrical in shape.

Subject 45:

Drainage trench unit according to any of subjects 40 to 44, in which at least one rib element (38), preferably a plurality of rib elements, protrudes radially inwards from the inner wall of at least one recess (30), preferably all recesses, said rib element/s being preferably provided with an insertion incline.

Subject 46:

Drainage trench unit according to any of subjects 1 to 39, in which a first quantity of pillars (18, 20), preferably one half of the pillars, comprise male connecting elements at their top ends (18*b*, 20*b*), whilst a second quantity of pillars (18, 20), preferably the other half of the pillars, comprise female connecting elements at their top ends (18*b*, 20*b*), the pillars in the first quantity of pillars and the pillars in the second quantity of pillars being arranged such that two identically formed drainage trench sub-units (12) arranged inversely with respect to one another in the vertical direction can be brought together so that pillars with male connecting elements, preferably all pillars with male connecting elements, each engage with a pillar with a female connecting element.

Subject 47:

Drainage trench unit according to any of subjects 1 to 46, in which the drainage trench unit (10) also comprises a tunnel element (26) which can be fastened in a "reverse U-shaped" configuration on the base wall (16) or on the intermediate element (14), the tunnel element (26) comprising openings allowing liquid to pass through, for example, and being preferably at least in part provided with a lattice structure.

Subject 48:

Drainage trench unit according to subject 47,
in which the tunnel element (26) can be fastened on the base wall (16) or the intermediate element (14) in a "lateral horizontal D-shaped" configuration, where the linear web (26*a*) of the D-shape runs substantially parallel to the surface of the base wall (16) or the intermediate element (14).

Subject 49:

Drainage trench unit according to any of subjects 1 to 46, in which the drainage trench unit (10) also comprises a tunnel element (26') which can be fastened in a "U-shaped" configuration on the base wall (16) or the intermediate element (14), the bottom leg of the U-shape running substantially parallel to the surface of the base wall (16) or the intermediate element (14), and the tunnel element (26') comprising openings allowing liquid to pass through, for example, and being preferably at least in part provided with a lattice structure.

Subject 50:

Drainage trench unit according to any of subjects 47 to 49, in which the tunnel element (26) lies at the side of the pillars (18) in the two adjacent pillar rows (22) and in some cases on top of the intermediate element (14) or the base wall (16).

Subject 51:

Drainage trench unit according to any of subjects 1 to 50, in which boundary elements (27) are provided, and which are, for example, articulated on the base wall (16) or the intermediate element (14) such that they can pivot and be able to be swiveled between a position which runs substantially parallel to the base wall (16) or the intermediate element (14) and an upright position, or are designed as plug-in components which can be connected to the base wall (16) and/or the pillars (18) defining the limits of the inspection passage by means of plug-in connections.

Subject 52:

Drainage trench unit according to subject 51,
in which the boundary elements (27) are at least partially designed with a lattice structure.

Subject 53:

Drainage trench unit according to any of subjects 47 to 52, in which the tunnel element (26, 26') or the boundary elements (27) is or are designed with a lattice structure which is adjacent to at least the upper side of the base wall (16) or the intermediate element (14).

Subject 54:

Drainage trench unit according to any of subjects 33 to 53, in which the intermediate element (14) comprises at least one pair of corresponding holding elements on its top and bottom sides, notably at least one protrusion and at least one recess which is positioned such that it corresponds to said protrusion.

Subject 55:

Drainage trench unit according to any of subjects 1 to 54, in which the drainage trench unit (10) also comprises at least one side end element (40) which is designed to be permeable to liquid, and which is, for example, designed at least partly as a lattice structure.

Subject 56:

Drainage trench unit according to subject 55,
in which the side end element (40) is only supported laterally on the base walls (16) of two drainage trench sub-units (12) which are oriented inversely with respect to one another.

Subject 57:

Drainage trench unit according to subject 55,
in which the side end element (40) is only supported laterally on the base walls (16) of two drainage trench sub-units (12) which are oriented inversely with respect to one another and an intermediate element (14) positioned between said drainage trench sub-units.

Subject 58:

Drainage trench unit according to subject 55,
in which the side end element (40) is only supported laterally on the base walls (16) of one drainage trench sub-unit (12) and an intermediate element (14) assigned to said drainage trench sub-unit.

Subject 59:

Drainage trench unit according to any of subjects 55 to 58, in which the side end element (40) is free of any contact, particularly lateral contact, with the pillars (18, 20) of the drainage trench sub-unit (12) or the drainage trench sub-units (12).

Subject 60:

Drainage trench unit according to any of subjects 55 to 59, in which the side end element (40) comprises latching elements (42) which can be engaged in corresponding latching recesses (44) in the base walls (16) of the two drainage trench sub-units (12) or in the base wall (16) of the drainage trench sub-unit (12) and in the intermediate element (14).

Subject 61:

Drainage trench unit according to subject 60,
in which at least one latching element (42) and the corresponding latching recess (44) are simultaneously designed as pivot bearings.

Subject 62:

Drainage trench unit according to any of subjects 13, 39, 47, 52 and 55 and, if desired, at least one of the subjects referred back to at least one of these subjects,
in which at least some of the lattice webs (16*a*) forming the lattice structure, preferably over 50% of these lattice webs, or even more preferably all of these lattice webs, are in the form of strips.

Subject 63:

Drainage trench unit according to subject 62,
in which the lattice webs (16*a*) are longer and wider than they are thick, their thickness preferably being less than one third, or even more preferably less than one fifth of the smaller of the two length and width dimensions.

Subject 64:

Drainage trench unit according to subject 63, in which the thickness dimension and the length dimension run in the extension plane of the base wall (16), whilst the width dimension runs at right angles to this plane.

Subject 65:

Drainage trench unit according to any of subjects 1 to 64, in which the at least one drainage trench sub-unit (12) and/or the intermediate element (14) and/or the side end element (40) are manufactured from plastics material, preferably as an injection moulded part, for example from polyethylene or polypropylene.

Subject 66:

Drainage trench unit according to any of subjects 1 to 65, in which the relative storage capacity of the drainage trench unit (10), i.e. the ratio of the volume of the drainage trench unit which can be used for water storage to the overall volume of the drainage trench unit has a value of more than 90%, preferably more than 95%.

Subject 67:

Transport unit (50) comprising at least one stack (52) of drainage trench sub-units (12) stacked on top of one another with at least one drainage trench sub-unit feature according to at least one of subjects 1 to 66.

Subject 68:

Transport unit according to subject 67, in which the stack (52) or each of the stacks (52) comprises an even number of drainage trench sub-units (12) and half as many intermediate elements (14).

Subject 69:

Transport unit according to subject 68, in which one of the intermediate elements (14) forms a base area of the stack (52), the even number of drainage trench sub-units (12) and then the remaining intermediate elements (14) being preferably arranged on the intermediate element (14) used as the base area.

Subject 70:

Transport unit according to subject 67, in which the stack (52) or each of the stacks (52) comprises an even number of drainage trench sub-units (12).

Subject 71:

Transport unit according to subject 70, in which the drainage trench sub-units (12) stand on a separate base area.

Subject 72:

Transport unit according to any of subjects 67 to 71, in which said transport unit comprises two stacks (52) positioned next to one another and firmly connected to one another.

The invention claimed is:

1. A drainage trench unit which comprises at least one drainage trench sub-unit, the at least one drainage trench sub-unit having a base wall and a plurality of hollow pillars, said pillars tapering away from the base wall, the pillars being connected integrally to the base wall, whilst the spaces between adjacent pillars are otherwise free of elements connecting said pillars, wherein the pillars are arranged in a grid having a plurality of pillar rows and a plurality of pillar columns, each pillar being assigned to one pillar row and one pillar column, and the spacing between a middle pair of adjacent pillar rows and/or pillar columns is larger than the spacings between other pillar rows or pillar columns which are adjacent to one another; and wherein at least one pillar has/have a cruciform cross-section, the outline of the cruciform cross-section including:

a shape that runs partly along the outline of a square, the side edges of said square running in parallel with the side edges of the base wall, and partly inside the outline of this square, but not outside the outline of this square, one portion of the outline of the cruciform cross-section, which is extending from at least one corner of this square, runs between a first outline point of the square and a second outline point of the square inside the outline of the square, said one portion of the outline of the cruciform cross-section running inside a connecting straight line between the first and second outline points of the square and outside or along at least a portion of a connecting line which has two rectilinear portions, each of said rectilinear portions departing from either the first or second outline points of the square and intersecting at right angles to the side edge on which the respective outline point is located, and said one portion of the outline of the cruciform cross-section being shorter than the connecting line.

2. The drainage trench unit according to claim 1, wherein the pillars are designed and/or the wall thickness and the degree of tapering or the conical angle of the pillars is/are dimensioned such that, when two identically formed drainage trench sub-units with the same orientation are stacked inside one another, a spacing between the base walls of the two drainage trench sub-units is less than the thickness of the base wall.

3. The drainage trench unit according to claim 1, wherein peripheral and corner pillars have a pre-defined spacing from an edge of the base wall.

4. The drainage trench unit according to claim 3, the spacing ranges between approximately 1 cm and approximately 5 cm.

5. The drainage trench unit according to claim 1, wherein a surface portion of the base wall is arranged between two adjacent pillar rows, said portion extending from a side edge of the base wall to its opposite side edge, is designed as a support surface, a surface thereof being breached by openings.

6. The drainage trench unit according to claim 1, wherein comprises two drainage trench sub-units which are arranged with the top ends of their pillars pointing towards one another, a plate-shaped intermediate element being arranged between the two drainage trench sub-units, said intermediate element connecting together the top ends of the pillars of the two drainage trench sub-units, wherein the intermediate element has a perimeter generally a same size and configuration as the base wall.

7. The drainage trench unit according to claim 1, wherein the drainage trench unit also comprises at least one side end element which is designed to be permeable to liquid.

8. The drainage trench unit according to claim 7, wherein the side end element comprises latching elements which are suitable to be latched in corresponding latching recesses in the base walls of two drainage trench sub-units or in the base wall of the drainage trench sub-unit and in the intermediate element.

9. The drainage trench unit according to claim 1, wherein the at least one drainage trench sub-unit and/or the intermediate element and/or the side end element is/are manufactured from plastics material.

10. The drainage trench unit according to claim 1, wherein a relative storage capacity of the drainage trench unit which is the ratio of the volume of the drainage trench unit which is usable for water storage to the overall volume of the drainage trench unit has a value of more than 90%.

11. The drainage trench unit according to claim 1, wherein the base wall comprises a peripheral surface which extends over more than 50% of the periphery of the base wall for a pre-defined distance over and above the remaining surface of the base wall in the same direction from the base wall as the pillars, the pre-defined distance being less than the thickness of the base wall.

12. The drainage trench unit according to claim 1, wherein the peripheral surface of the base wall is substantially the same height as the remaining base wall at two opposite portions which are assigned to opposite side edges of the base wall.

13. A use of an inspection device equipped with lateral guide elements for inspection of a drainage trench comprised of several drainage trench units according to claim 1, by moving the inspection device in the space between a pair of adjacent pillar rows and/or pillar columns of the drainage trench units, said pair of pillar rows or columns having a larger spacing than the spacings between other pillar rows or pillar columns which are adjacent to one another.

14. A transport unit comprising at least one stack of drainage trench sub-units stacked on top of one another with at least one drainage trench sub-unit feature according to claim 1, in which the drainage trench sub-units stand on a separate base area, and in which the transport unit comprises two stacks positioned next to one another and firmly connected together.

15. The drainage trench unit according to claim 6, wherein the intermediate element includes recesses and latching elements for connecting together said two drainage trench sub-units and holding said two drainage trench sub-units together in a horizontal direction and a vertical direction.

16. The drainage trench unit according to claim 1, wherein each of said pillars has a wall thickness that increases from a base end to a top distal end.

17. The drainage trench unit according to claim 1, wherein the pillars include a first group of pillars and a second group of pillars, the first group of pillars having a square base outline and the second group of pillars having a substantially circular base outline, at least one of the plurality of pillar rows and/or the plurality of pillar columns alternating with the first and second pillar groups.

18. The drainage trench unit according to claim 17, wherein both the plurality of pillar rows and the plurality of pillar columns alternate with the first and second pillar groups.

19. A drainage trench unit which comprises at least one drainage trench sub-unit, the at least one drainage trench sub-unit having a base wall and a plurality of hollow pillars, said pillars tapering away from the base wall, the pillars being connected integrally to the base wall, whilst the spaces between adjacent pillars are otherwise free of elements connecting said pillars, wherein the pillars are arranged in a grid having a plurality of pillar rows and a plurality of pillar columns, each pillar being assigned to one pillar row and one pillar column, and the spacing between a middle pair of adjacent pillar rows and/or pillar columns is larger than the spacings between other pillar rows or pillar columns which are adjacent to one another; and further including a boundary wall pivotally connected to the base wall for swivel movement from a parallel position to a perpendicular position at the location of the spacing between the middle pair of adjacent pillar rows and/or pillar columns.

* * * * *